US006945471B2

(12) United States Patent
McKenzie et al.

(10) Patent No.: US 6,945,471 B2
(45) Date of Patent: Sep. 20, 2005

(54) ROTARY SPRINKLER

(75) Inventors: Jeff R. McKenzie, Lake Arrowhead, CA (US); Peter Janku, Temecula, CA (US); Rebecca R. Lichte, Riverside, CA (US); Chad P. McCormick, Riverside, CA (US)

(73) Assignee: The Toro Company, Bloomington, MN (US)

( * ) Notice: Subject to any disclaimer, the term of this patent is extended or adjusted under 35 U.S.C. 154(b) by 503 days.

(21) Appl. No.: 10/014,916

(22) Filed: Oct. 22, 2001

(65) Prior Publication Data

US 2002/0153432 A1 Oct. 24, 2002

Related U.S. Application Data

(60) Provisional application No. 60/243,538, filed on Oct. 26, 2000.

(51) Int. Cl.[7] ..... B05B 3/04

(52) U.S. Cl. ..... 239/237; 239/240; 239/242; 239/247; 239/590; 239/206; 239/71; 239/73

(58) Field of Search ..... 239/71, 73, 203, 239/204, 206, 276, DIG. 1, 237, 240, 241, 242, 246, 247, 569, 570, 590, 590.5

(56) References Cited

U.S. PATENT DOCUMENTS

| | | | | | |
|---|---|---|---|---|---|
| 207,756 | A | * | 9/1878 | Maguire | 239/276 |
| 1,541,702 | A | * | 6/1925 | Geisendorfer | 239/240 |
| 2,212,533 | A | * | 8/1940 | Zimmerman | 239/DIG. 1 |
| 2,979,272 | A | * | 4/1961 | Thorrez | 239/259 |
| 3,149,784 | A | * | 9/1964 | Skidgel | 239/206 |
| 3,921,912 | A | * | 11/1975 | Hayes | 239/242 |
| 4,253,608 | A | * | 3/1981 | Hunter | 239/206 |
| 4,892,252 | A | * | 1/1990 | Bruninga | 239/206 |
| 5,148,991 | A | * | 9/1992 | Kah, Jr. | 239/242 |
| 5,375,768 | A | * | 12/1994 | Clark | 239/570 |
| 5,383,600 | A | * | 1/1995 | Verbera et al. | 239/242 |
| 5,435,490 | A | * | 7/1995 | Machut | 239/276 |
| 5,676,315 | A | * | 10/1997 | Han | 239/590 |
| 5,687,910 | A | * | 11/1997 | King | 239/276 |
| 5,762,270 | A | | 6/1998 | Kearby | |
| 6,039,268 | A | * | 3/2000 | Grundy et al. | 239/73 |
| 6,186,413 | B1 | * | 2/2001 | Lawson | 239/570 |
| 6,209,801 | B1 | * | 4/2001 | Kearby et al. | 239/206 |
| 6,237,862 | B1 | * | 5/2001 | Kah et al. | 239/548 |

* cited by examiner

*Primary Examiner*—Steven J. Ganey
(74) *Attorney, Agent, or Firm*—James W. Miller

(57) ABSTRACT

A rotary sprinkler having an adjustable arc segment whose angular extent and absolute direction relative to the ground are represented by an arc indicator, which arc indicator may comprise a band whose visible length represents the angular extent and whose position on the sprinkler points to the direction. The sprinkler may have the arc segment adjusted by a movable arc limit stop that is coupled to a toggle member only at drive reversal, and the sprinkler may be converted to full circle operation by raising the arc limit stop relative to a cooperating trip tab. A buckling spring assembly used to shift the drive comprises a compression spring held between two spaced pivot members, and the drive can be built in continuous and intermittent drive versions by replacing a few normal rotary gears with multilated gears. A friction clutch having asymmetric teeth for smooth operation prevents damage to the drive during forced nozzle rotation. A nozzle assembly includes a pivotal nozzle that carries a radius adjustment screw with the head of the screw received on top a flexible portion of a top cover, which top cover has laser etched indicia relating to various adjustments of the sprinkler. A flow shut off valve includes stream straightening vanes and a collar may be used to support the sprinkler on a stake or post for above ground installation.

91 Claims, 20 Drawing Sheets

ROTARY SPRINKLER

CROSS REFERENCE TO RELATED APPLICATIONS

This application claims the benefit of one or more previously filed copending provisional applications identified as follows: application Ser. No. 60/243,538 filed Oct. 26, 2000.

TECHNICAL FIELD

This invention relates to a rotary sprinkler having a rotatable nozzle assembly for watering an arc of ground traversed or swept by the nozzle assembly as the nozzle assembly rotates. More particularly, this invention relates to a sprinkler of this type in which the trajectory of the water being thrown by the nozzle assembly can be easily adjusted, in which the arc of ground being watered by the nozzle assembly can be easily adjusted, and which includes an indicator for indicating both the angular extent and the direction of the arc of ground being watered by the nozzle assembly, among other things.

BACKGROUND OF THE INVENTION

Rotary sprinklers are known which have rotary nozzle assemblies that oscillate back and forth through an adjustable arc of rotation to water an adjustable arc segment on the ground. Some such sprinklers have indicators for indicating to the user the angular extent of the arc segment that has been set by the user. These indicators are typically carried on the rotary nozzle assembly which moves relative to the rest of the sprinkler. Thus, such indicators do not continuously or absolutely indicate to the user the direction in which the arc segment is oriented, which would be useful information for the user to have.

In addition, many arc indicators comprise an angular scale and a cooperating pointer. Typically, the scale and pointer are relatively small. This can make them somewhat difficult to read. Accordingly, there is a need in the art for an arc indicator which may be more easily read and which more graphically represents the angular extent of the arc indicator without having to read a pointer against a numerical scale.

Prior art rotary sprinklers are typically provided with some type of arc adjusting mechanism, often comprising two arc limit stops which are relatively adjustable to one another. Such stops are typically carried adjacent to one another with the stops being continuously coupled to a part of the drive reversing mechanism. In adjusting one stop relative to another, the adjustable stop(s) are often necessarily ratcheted over serrations or detents, thus making adjustment somewhat difficult or unnatural. No rotary sprinklers are known in which the stops are freely adjustable relative to one another with the adjustable stops being coupled to the drive reversing mechanism only at moments of drive reversal.

Some rotary sprinklers of this type can be adjusted between part circle and true full circle operation. This is done by having the arc limit stops abut one another when the sprinkler is set to 360° such that the trip mechanism rides over the abutted arc limit stops without tripping. Other sprinklers require one of the arc limit stops to be manually pivoted up out of the way of the trip mechanism. No rotary sprinklers are known in which one of the arc limits stops is automatically moved vertically up out of the way of the trip mechanism whenever the sprinkler is set to 360° to automatically convert to full circle operation.

Rotary sprinklers having oscillating drives often use springs as part of the mechanism which toggles a shiftable part of the drive to reverse the drive direction. Some such springs are elongated leaf springs which buckle between their top and bottom ends. Such leaf springs are somewhat difficult to manufacture and are somewhat less durable than would otherwise be desirable. A buckling spring assembly using a simple compression spring would be desirable but is not known in prior art sprinklers.

Rotary sprinkler drives are known that provide continuous motion and other rotary sprinkler drives are known that provide intermittent motion. These drives have in the past been built as separate drives and not as drives that are different versions of a common drive. A method of manufacturing a common drive which is easily manufactured in a continuous or intermittent version would be desirable.

Rotary sprinklers having rotary drives often include some type of clutch that allows the rotary nozzle assembly to be forced past the drive without damaging the drive. Some such clutches comprise detent or serration type clutches as well as simple friction clutches. It would be desirable to have a clutch that acts like a friction clutch in terms of smoothness of operation but which has some opposed teeth to enhance the holding power of the clutch. It would also be desirable to have such a clutch which retains its holding ability even after the clutch is exposed to the various contaminants that are found in the water flowing through the sprinkler.

Rotary nozzle assemblies as used on various types of sprinklers have previously been provided with nozzles whose trajectory can be adjusted. However, such nozzle assemblies have not included those which use radius adjustment screws to selectively break up the stream from the nozzle to shorten the radius. Such nozzle assemblies equipped with radius adjustment screws have not been adjustable in trajectory. It would be desirable to have a trajectory adjustable nozzle that also includes a radius adjustment screw.

Rotary sprinklers have been equipped with flow shut off valves that involve placing an elongated member into the water flow path through the nozzle. Such an elongated member disturbs the water stream flowing through the nozzle, which is obviously undesirable. A way to overcome this water disturbance phenomenon would be an advantage.

Rotary sprinklers having different types of adjustments are known with the covers of such sprinklers having indicia to instruct or inform the user about the adjustments or how to make the adjustments. Such indicia have in the past been difficult to read. A way to improve the readability of the indicia would be a step forward in the art.

While rotary sprinklers are often buried in the ground, they are sometimes tied to stakes or posts extending up out of the ground. This is usually done simply by tying the sprinkler body to the post using wire or cords or some other relatively crude connection. A more elegant and stable method of securing the sprinkler to a stake or post would be desirable.

SUMMARY OF THE INVENTION

One aspect of this invention is to provide a rotary sprinkler which waters an adjustable arc segment on the ground which includes an arc indicator that both indicates the angular extent of the arc segment as well as absolutely indicates where that arc segment is directed relative to the ground. Another aspect of this invention is an arc indicator that comprises a band with a visible length in place of the more commonly known pointer and cooperating numerical scale.

Another aspect of this invention is to provide a rotary sprinkler with an adjustable arc segment defined by the distance between two arc limit stops. An adjustable arc limit stop is connected to a toggle member only at moments of drive reversal. Yet another aspect of this invention relates to converting a rotary sprinkler to full circle operation by automatically moving at least one of the arc limit stops out of engagement with a trip tab whenever the sprinkler is set to water 360°.

Another aspect of this invention is in a rotary sprinkler having a shiftable or reversible oscillating drive including a buckling spring. In this aspect of the invention, the buckling spring includes a compression spring whose ends are secured to first and second pivot members. The compression spring buckles between its ends as one pivot member pivots relative to the other pivot member.

Yet another aspect of this invention is to provide a rotary drive for a sprinkler that can be easily built in intermittent or continuous drive versions. A continuous drive version is built in which all the gears are normal rotary gears with regularly shaped teeth. To build the intermittent version of the drive, a few of the normal rotary gears in the continuous drive version of the drive are replaced with multilated gears.

Another aspect of this invention relates to a friction clutch for preventing damage to a rotary sprinkler drive during periods of forced nozzle rotation. Such a friction clutch includes opposed sets of teeth on the clutch members with the teeth being asymmetrically arranged relative to one another. An O-ring is placed between the teeth of the clutch members. In yet another aspect of this invention, the O-ring is pre-lubricated in an oil to compensate for the effects of the contaminants typically found in the water flowing through the sprinkler.

Another aspect of this invention relates to a rotary sprinkler having a rotary nozzle assembly in which the nozzle is pivotal to have its trajectory adjusted. In this aspect of the invention, the pivotal nozzle is carried in a cradle that also carries a radius adjustment screw so that the radius adjustment screw pivots with the nozzle to maintain a fixed relationship to the nozzle once the screw has been adjusted. In yet another aspect of this invention, the radius adjustment screw has an enlarged head carried on top of a flexible portion of the cover which flexible cover portion can tilt or flex relative to the rest of the cover as the nozzle trajectory changes. This permits the radius adjustment screw to be operated from above the sprinkler despite any changes in the nozzle trajectory.

Another aspect of this invention relates to a stream straightener having flow straightening vanes to lessen any disturbance which the stream straightener might otherwise impose on the water flowing through the sprinkler.

Another aspect of this invention relates to a rotary sprinkler having a cover which carries indicia relating to various adjustments of the sprinkler, the indicia having been laser etched onto the cover.

Yet another aspect of this invention relates to a removable member that can be attached to a sprinkler to more easily attach the sprinkler to an upstanding stake for above ground installation of the sprinkler.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

Introduction

Figure 1:
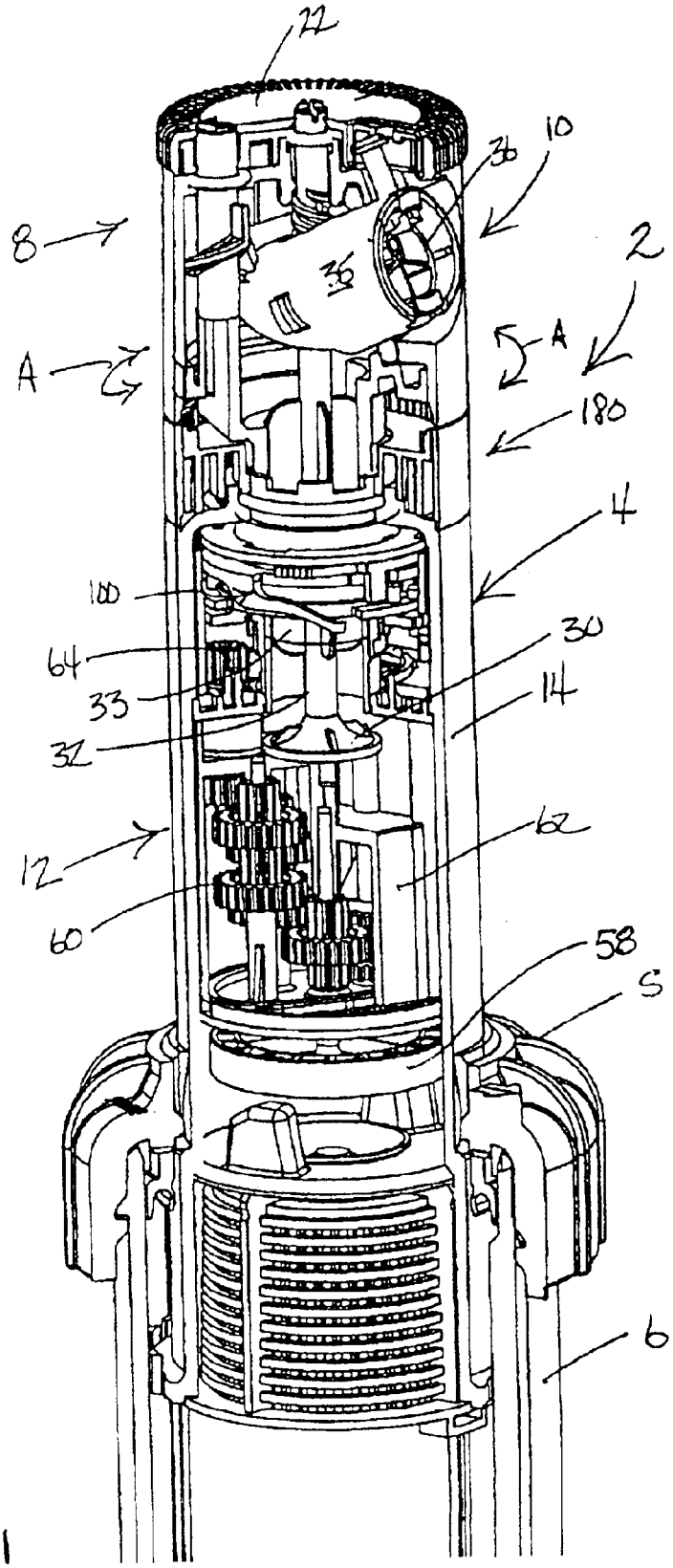
FIG. 1 is a perspective view of a sprinkler according to this invention, showing the sprinkler riser popped up, and with a portion of the sprinkler body and sprinkler riser being broken away to show various internal components of the sprinkler, the bull gear being omitted from this view for the purpose of clarity.
Figure 2:
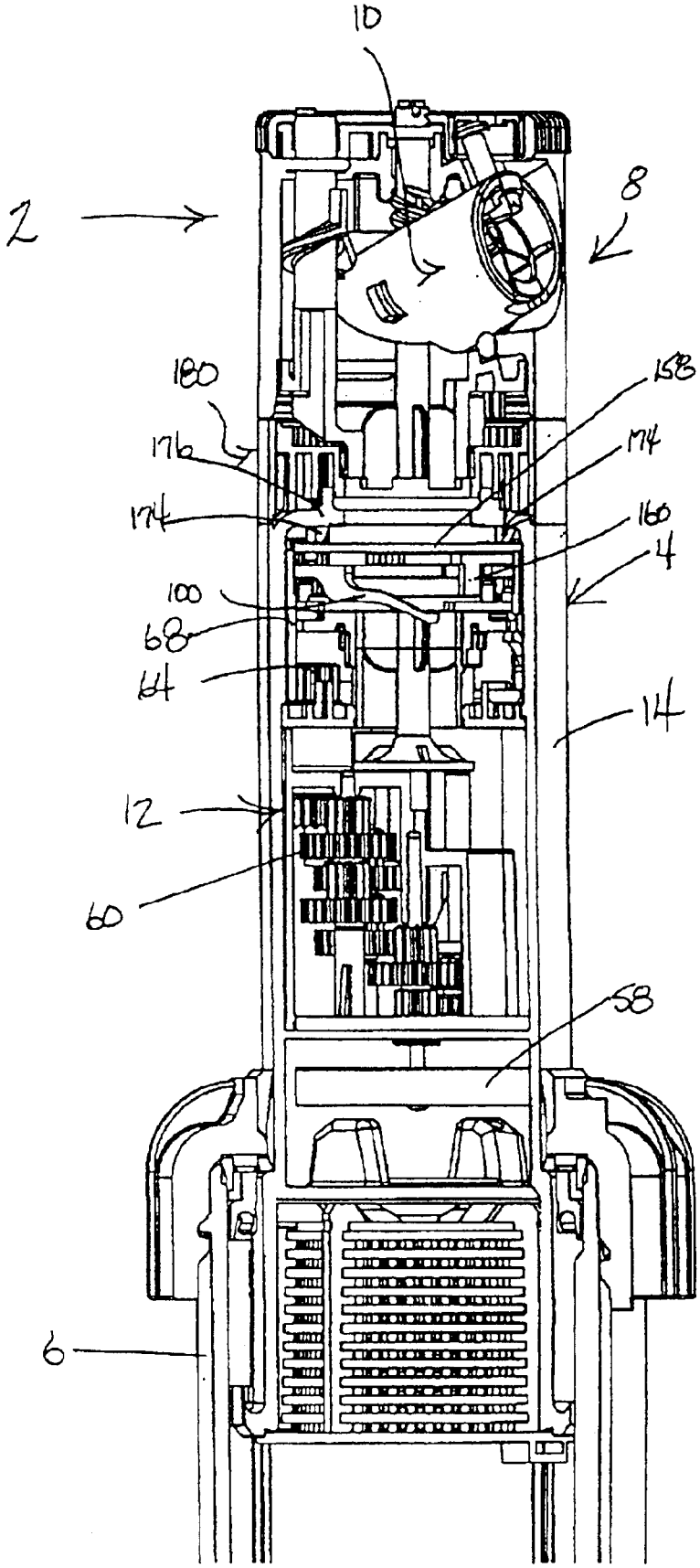
FIG. 2 is a side elevational view of a sprinkler according to this invention, showing the sprinkler riser popped up, and with a portion of the sprinkler body and sprinkler riser being broken away to show various internal components of the sprinkler, the bull gear being omitted from this view for the purpose of clarity.

Referring first to FIGS. 1 and 2, this invention relates to a water sprinkler, generally identified as 2 in the drawings, for irrigating an area of ground or turf. Sprinkler 2 preferably comprises a pop-up sprinkler in which a pop-up riser 4 is reciprocally carried within an outer sprinkler body 6. When water pressure is not present within the interior of sprinkler body 6, riser 4 is retracted by a retraction spring (not shown) within sprinkler body 6 so that the top of riser 4 is generally flush with a cap 5 on the top of sprinkler body 6. However, when water pressure is present within sprinkler body 6, as when a valve upstream of sprinkler body 6 or within the water inlet of sprinkler body 6 in the case of a valve-in-head sprinkler is opened, such water pressure acts against riser 4 to pop riser 4 up out of sprinkler body 6. FIGS. 1 and 2 illustrate riser 4 in its popped up orientation. When riser 4 pops up, a nozzle assembly 8 at the top of riser 4 is exposed to allow the water entering sprinkler 2 through the inlet to be ejected by at least one nozzle 10 carried in nozzle assembly 8.

Riser 4 preferably houses a rotary drive 12 for rotating nozzle assembly 8 about a substantially vertical axis. Riser 4 itself preferably has two major components. The first riser component is a non-rotatable drive housing 14 in which rotary drive 12 is housed. The second riser component is a rotatable nozzle assembly 8 which sits atop drive housing 14. During operation of sprinkler 2, nozzle assembly 8 rotates relatively to drive housing 14 as illustrated by the arrows A in FIG. 1.

The Nozzle Assembly

Referring now to FIGS. 3–7, nozzle assembly 8 includes a nozzle housing 16 having a generally cylindrical form. Nozzle housing 16 includes a cylindrical sidewall 18 and a top wall 20 fixedly secured thereto. A flexible rubber cover 22 is adhered to top wall 20 of nozzle housing 16 by attaching cover 22 to a retainer plate 21, which retainer plate 21 is itself fixedly attached to top wall 20 thereby trapping various O-ring seals between plate 21 and top wall 20. See FIGS. 3 and 5. Sidewall 18 of nozzle housing 16 includes an outwardly extending cavity or seat 24 in which nozzle 10 is received for throwing a stream of water to one side of nozzle assembly 8.

Nozzle assembly 8 includes a downwardly extending water supply tube 26 that conducts water passing up through drive housing 14 into the interior of nozzle housing 16. This water will pass outwardly through nozzle 10 in a stream like form.

The Flow Shut Off Valve

A manually operable flow shut off valve 28 can be installed on the centerline of nozzle housing 16. Flow shut off valve 28 has a valve member 30 for stopping water from flowing into water supply tube 26 when valve member 30 is engaged with the end of water supply tube 26. Flow shut off valve 28 has a shaft 32 with a threaded section 31 that permits the user to unscrew flow shut off valve 28 to move valve member 30 down away from water supply tube 26 sufficiently to allow water to pass through water supply tube 26 into nozzle housing 16. Shaft 32 of flow shut off valve 28 has an opening 29 in its top end to allow a tool, such as a screwdriver, to be used to rotate shaft 32. A plurality of stream straightening vanes 33 are provided on shaft 32 for engaging the inner diameter of water supply tube 26, such vanes 33 helping guide shaft 32 up and down within water supply tube 26 as well as reducing turbulence in the flow passing through water supply tube 26.

The Pivotal Nozzle

Nozzle assembly 8 of sprinkler 2 of this invention includes a nozzle 10 that is pivotally mounted within nozzle housing 16. Nozzle 10 comprises a cylindrical nozzle body 35 pivotally received in a nozzle cradle 34 for pivoting motion about a substantially horizontal pivot axis to adjust the trajectory of the water stream exiting from nozzle body 35. A removable nozzle member 36 having a nozzle outlet 38 is press fit or otherwise removably but tightly secured in the outer end of pivotal nozzle body 35. Different nozzle plates 36 having differently shaped or sized nozzle outlets 38 can thus be fit into nozzle body 35 to vary the shape or gallonage of the water stream being thrown by nozzle body 35.

Pivotal nozzle body 35 includes a seat 44 on one side forming a gap 45 which receives a thread or worm 46 on a trajectory setting shaft 48. Trajectory setting shaft 48 is vertically oriented and is rotatably journalled at its lower end on a pivot pin 50 in the inside of nozzle housing 16. Trajectory setting shaft 48 runs to the top of nozzle housing 16 and its top end has an opening shaped to receive a screwdriver or similar tool. The top end of trajectory setting shaft 48 is accessible through a hole 52 in cover 22 of nozzle assembly 8. When trajectory setting shaft 48 is rotated, the engagement of worm 46 on shaft 48 with seat 44 on nozzle body 35 pivots nozzle body 35 to raise or lower the outer end of nozzle body 35 to thereby adjust the trajectory of nozzle body 35. Thus, rotating trajectory setting shaft 48 in one direction will pivot the outer end of nozzle body 35 upwardly to raise the trajectory of the water stream being thrown by nozzle body 35. Rotating trajectory setting shaft 48 in the opposite direction will pivot the outer end of nozzle body 35 downwardly to lower the trajectory of the water stream being thrown by nozzle body 35.

Figure 3:
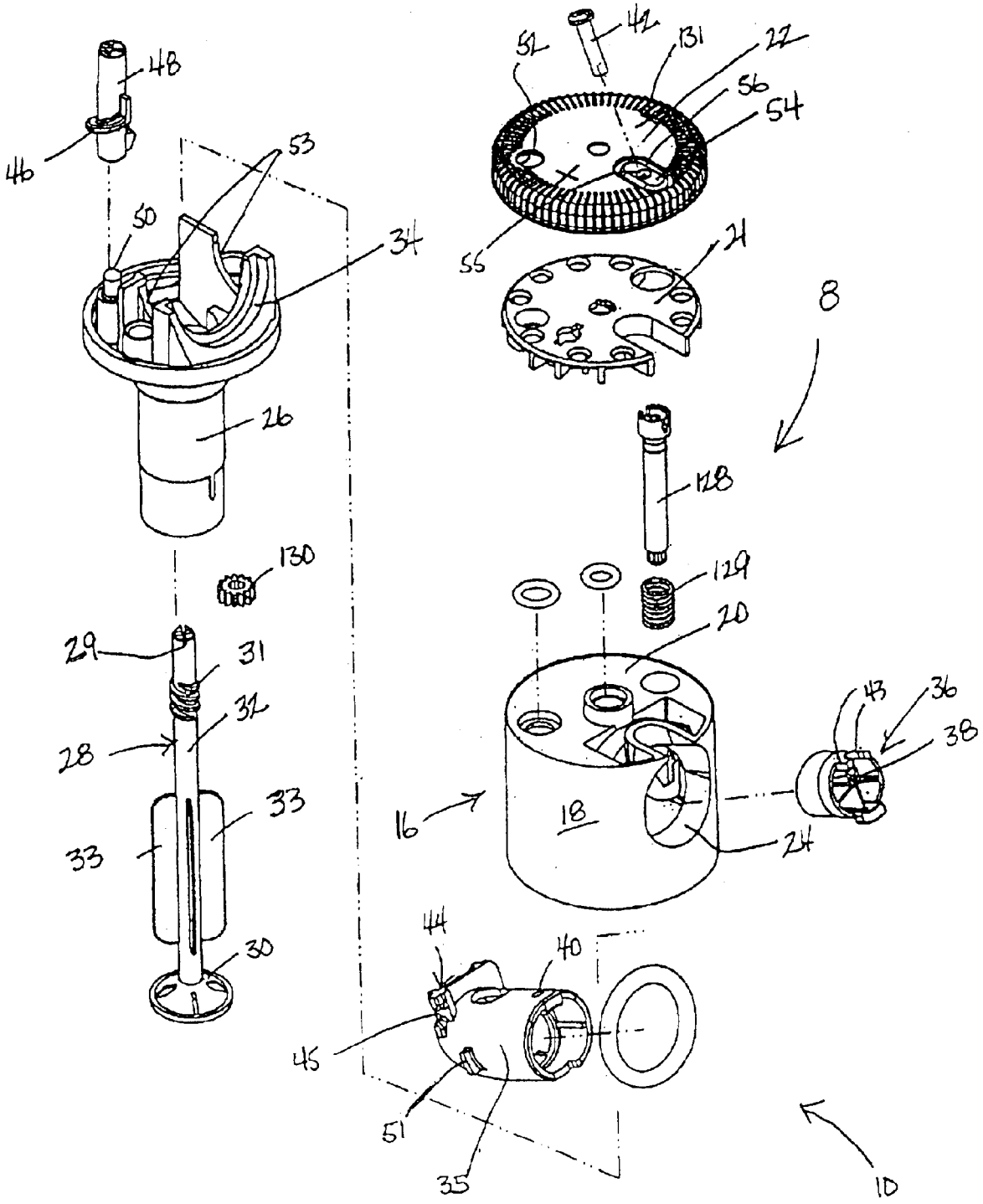
FIG. 3 is an exploded perspective view of the nozzle assembly of the sprinkler shown in FIG. 1.
Figure 4:
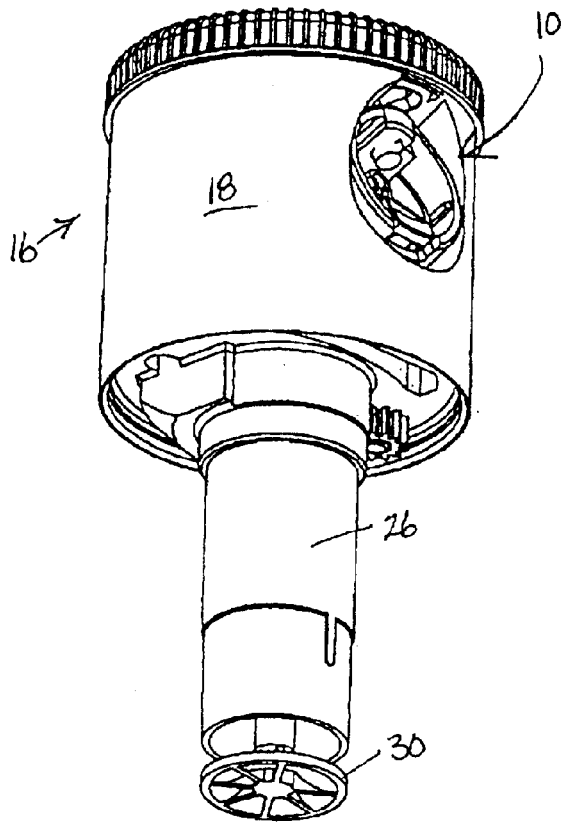
FIG. 4 is a perspective view of the nozzle assembly of the sprinkler shown in FIG. 1 looking up at the nozzle assembly.
Figure 5:
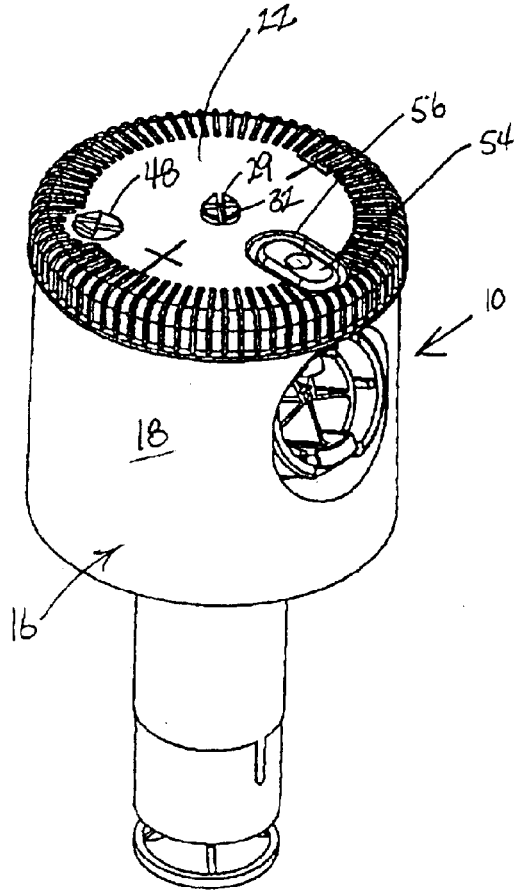
FIG. 5 is a perspective view of the nozzle assembly of the sprinkler shown in FIG. 1 looking down at the nozzle assembly.
Figure 6:
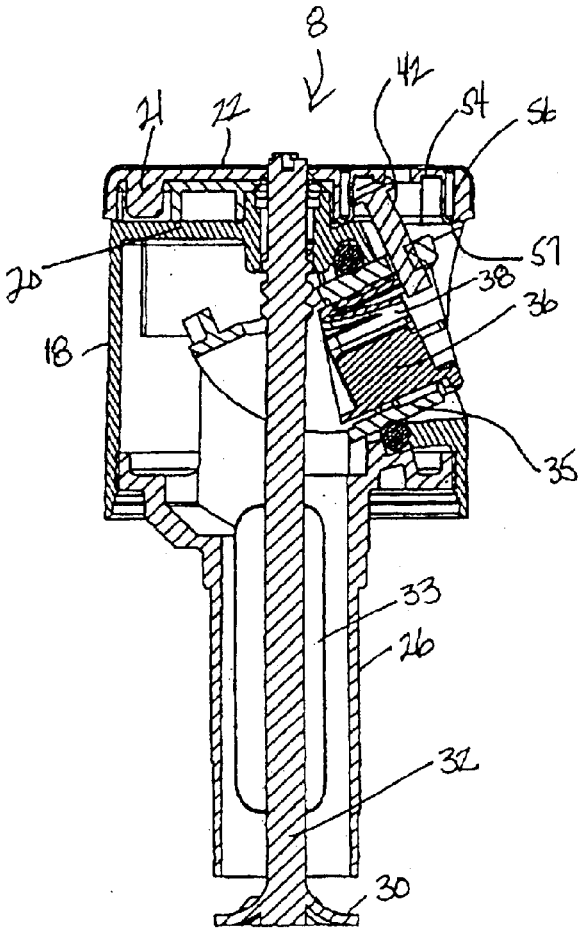
FIG. 6 is a cross-sectional view of the nozzle assembly shown in FIGS. 4 and 5, particularly illustrating the pivotal nozzle from the side thereof.

Nozzle body 35 can be pivotally mounted in nozzle housing 16 in any suitable manner. One way to do this is shown in FIG. 3. Nozzle body 35 is formed with curved tabs 51 extending to each side with only one such tab 51 being shown in FIG. 3. Such curved tabs 51 are captured in curved slots within housing 16 to form a pivotal connection with nozzle housing 16. Nozzle housing 16 has two lower curved surfaces shown at 53 in a portion of nozzle housing 16. When nozzle housing 16 is assembled together, two other upper curved surfaces (not shown) will overlie and be spaced from the two lower curved surfaces 53 to form two curved slots in which tabs 51 will be captured. Rotating trajectory setting shaft 48 will pivot nozzle body 35 about a horizontal axis with tabs 51 riding or sliding up or down on lower curved surfaces 53 of the slots as nozzle body 35 pivots.

The advantages of being able to adjust the trajectory of the water stream being thrown by pivotal nozzle 10 are apparent. It allows the user to select or adjust the trajectory without having to install different nozzles on sprinkler 2.

To assist the user in adjusting the trajectory, rubber cover 22 can be marked with indicia which indicates to the user the directions to turn trajectory setting shaft 48 to increase or decrease the trajectory and which indicates the maximum and minimum trajectory angles. This is further described in the following section of this Detailed Description entitled The Indicia on the Cover.

The Radius Adjustment Screw

As shown in FIG. 3, nozzle body 35 includes an opening 40 into which the lower end of a radius adjustment or stream break up screw 42 is threaded. Nozzle member 36 includes alignment fingers 43 between which radius adjustment screw 42 will pass when nozzle body 35, nozzle member 36 and radius adjustment screw 42 are all properly assembled together. Threading radius adjustment screw 42 up or down in opening 40 on nozzle body 35 will cause the lower end of radius adjustment screw 42 to move into or out of the stream exiting from nozzle outlet 38 in nozzle member 36. This will cause the radius of the stream to shorten or lengthen, respectively, due to stream break up. Such radius adjustment screws 42 are well known in sprinklers of this type.

Because radius adjustment screw 42 is carried on pivotal nozzle 10 itself by virtue of being carried on pivotal nozzle body 35, radius adjustment screw 42 also travels with nozzle 10 during a trajectory adjustment. Thus, radius adjustment screw 42 is always available for use regardless of the selected trajectory.

The top of radius adjustment screw 42 is preferably retained above cover 22 of nozzle assembly 8 to allow radius adjustment screw 42 to be quickly located and rotated. Normally, in sprinklers of this general type, the cover of the sprinkler has a hole or slit through which a tool can be inserted to reach and rotate the radius adjustment screw. However, because radius adjustment screw 42 is carried on a pivotal nozzle to swing or tilt relative to cover 22, it would be more difficult to access the head of screw 42 by sticking a tool down through a hole or slit and blindly trying to find the screw head since the screw head no longer necessarily remains aligned with the access hole or slit. Accordingly, in this invention, the head of radius adjustment screw 42 is always visible on top of cover 22 to allow the user to easily locate the screw head and to insert an adjustment tool into the screw head.

To locate the head of radius adjustment screw 42 atop cover 22 and to permit movement of screw 42 relative to cover 22, flexible rubber cover 22 is provided with a screw head receiving portion 54 having an opening 55 through which the shank of screw 42 extends with the head of screw 42 being retained on top of screw head receiving portion 54. See FIG. 3. This screw head receiving portion 54 of rubber cover 22 can flex or bend with respect to the rest of cover 22 since portion 54 is separated from the rest of cover 22 by a channel 56 and is only connected to the rest of cover 22 by a thin membrane 57 at the bottom of channel 56. See FIG. 6. Thus, as the trajectory of nozzle body 35 changes and as the top of radius adjustment screw 42 tilts relative to rubber cover 22, or as screw 42 is adjusted upwardly and downwardly, both this tilting and up and down movements of the top of the radius adjustment screw 42 are accommodated since screw head receiving portion 54 of cover 22 can similarly tilt or be compressed relative to the rest of cover 22 without distorting or deforming the rest of cover 22.

The Rotary Drive

Figure 24:
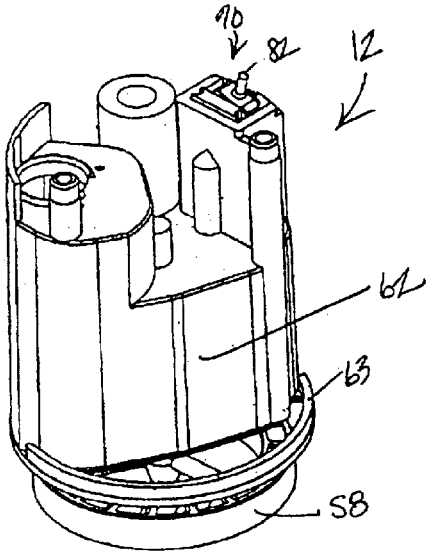
FIG. 24 is a perspective view of a typical rotary drive used in the sprinkler of FIG. 1.

Rotary drive 12 can have different forms. One form of rotary drive 12, and the form illustrated in FIGS. 1, 2 and 24, comprises a speed reducing gear drive carried within drive housing 14. Rotary drive 12 has a turbine 58 at its lower end, a gear train 60 including a plurality of speed reducing gear stages stacked above turbine 58 with the gear stages being located in a gear case 62, and an output gear 64. Turbine 58 is exposed to the water flowing through sprinkler 2 such that turbine 58 is spun or rotated at relatively high speed by the water flow. Gear train 60 progressively slows the rotational speed so that output gear 64 is rotated at a much slower speed, and correspondingly at higher power or torque, than turbine 58. Output gear 64 meshes with a bull gear 66, which drives nozzle assembly 8, such that bull gear 66 rotates at an even slower speed than output put gear 64 of gear train 60. Accordingly, nozzle assembly 8 is rotated by bull gear 66 at a very low speed compared to the speed of rotation of turbine 58.

Continuous or Intermittent Drive

Rotary sprinkler gear drives of this type are well known in the sprinkler art. The gears within such a drive 12 can be shaped to provide continuous, albeit slow speed, rotation of output gear 64. Alternatively, if so desired, some of the gears within the drive can comprise the multilated gearing disclosed in U.S. Pat. No. 5,758,827, assigned to the assignee of this application, which patent is herein incorporated by reference. When such multilated gearing is used, rotary drive 12 provides a periodic pause in the rotation of output gear 64 such that nozzle assembly 8 is both slowly and intermittently driven. In other words, when such multilated gearing is used, nozzle assembly 8 will slowly rotate, will pause or stop momentarily, will slowly rotate again, will pause or stop momentarily again, and so on. Continuous or intermittent rotation is provided by the nature of drive 12 installed into sprinkler 2 when sprinkler 2 is built, i.e. intermittent rotation will be provided when a drive 12 built with the multilated gearing of U.S. Pat. No. 5,758,827 is used and continuous rotation will be provided when a drive built with conventional gearing is used.

Figure 27:
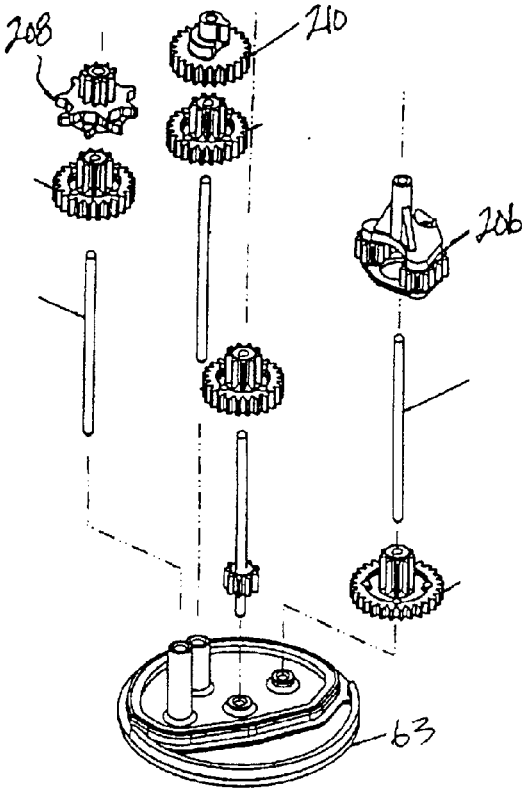
FIG. 27 is an exploded perspective view of a portion of a first embodiment for the drive shown in FIG. 24, particularly illustrating a rotary drive designed to provide intermittent rotation.
Figure 28:
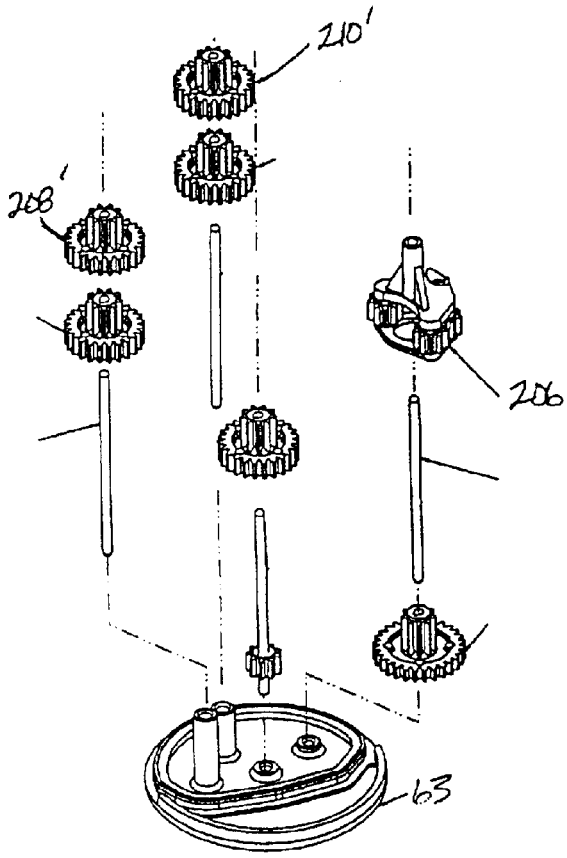
FIG. 28 is an exploded perspective view, similar to FIG. 27, of a portion of a second embodiment for the drive shown in FIG. 24, particularly illustrating a rotary drive designed to provide continuous rotation.

The Applicants have realized that sprinklers 2 can be easily built with either a continuous or intermittent drive by standardizing much of the drive and only changing a few gears therein when the drive is built. This is illustrated in FIGS. 27 and 28, which show the speed reducing gear stages of gear train 60 in an exploded form, such stages normally being enclosed within gear case 62. The only part of gear case 62 shown in FIGS. 27 and 28 is the base 63 thereof.

In any event, by comparing FIGS. 27 and 28, it is seen that the two drives are identical except for the last two speed reducing gears. In the continuous drive illustrated in FIG. 28, these last two speed reducing gears 208' and 210' have conventional gear teeth throughout. However, in the intermittent drive illustrated in FIG. 27, these last two speed reducing gears 208 and 210 are the multilated gearing disclosed in U.S. Pat. No. 5,758,827. Since the two drives except for the last two speed reducing gears within the gear case are otherwise identical, both drives can be quickly and inexpensively manufactured. One can easily select whether a continuous or intermittent drive is provided simply by selecting which gears 208 and 210, or 208' and 210', to use as the last two speed reducing gears in gear train 60.

For any particular drive 12 that is used, i.e. whether such is a continuous or intermittent drive, rotary gear drive 12 is able to provide oscillating rotation of nozzle assembly 8. In other words, drive 12 will rotate nozzle assembly 8 first in one direction and will then reverse nozzle assembly 8 to rotate nozzle assembly 8 in the opposite direction. Such oscillating rotation will be provided between two arc limit stops 98 and 100 such that sprinkler 2 will water an arc segment that is controlled by the angular distance between the two stops. In other words, if arc limit stops 98 and 100 are set apart to provide quarter circle rotation, then nozzle assembly 8 will rotate or oscillate back and forth within a 90° arc to water a quarter of a circle. Similarly, if arc limit stops 98 and 100 are set further apart to provide half circle rotation, then nozzle assembly 8 will rotate or oscillate back and forth within a 180° arc to water a half circle.

Oscillating rotation is achieved by shifting a reversing gear plate (shown at 206 in FIGS. 27 and 28) located within gear train 60 at a point near turbine 58 where the torque is low. A shiftable, cylindrically shaped toggle member 68 located above gear case 62 is connected to the reversing gear plate by a vertically extending buckling spring assembly 70 which extends down into gear case 62 along the side of gear train 60. When toggle member 68 is toggled back and forth about a vertical axis, buckling spring assembly 70 will be buckled back and forth between oppositely disposed over center positions, to thereby shift the reversing gear plate back and forth between one of two different drive positions. In one drive position, the reversing gear plate interposes one gear into gear train 60 to achieve rotation of output gear 64 in a first direction. In the other drive position, the reversing gear plate interposes another oppositely rotating gear into gear train 60 to achieve rotation of output gear 64 in a second opposite direction. The details of the reversing gear plate, shiftable toggle member, and a buckling spring assembly are disclosed in U.S. Pat. No. 5,673,855, assigned to the assignee of this invention, which patent is also incorporated above by reference.

The Buckling Spring Assembly

Figure 26:
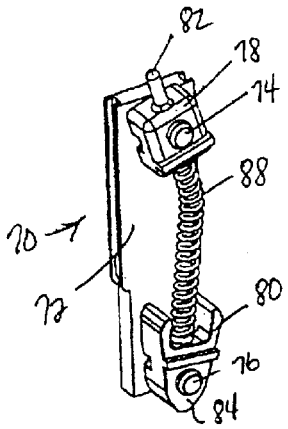
FIG. 26 is a perspective view of the buckling spring assembly shown in FIG. 25.
Figure 25:
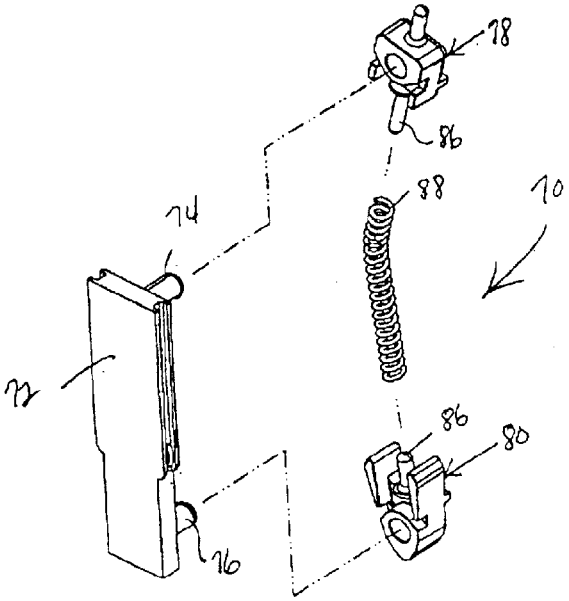
FIG. 25 is an exploded perspective view of a buckling spring assembly used in the drive of FIG. 24.

Referring to FIGS. 25 and 26, an improved buckling spring assembly 70 is disclosed formed by a base plate 72 having vertically spaced pivot pins 74 and 76 extending to one side of base plate 72. An upper pivot member 78 is pivotally journalled around upper pivot pin 74 and a lower pivot member 80 is pivotally journalled around lower pivot pin 76. Upper pivot member 78 has an upwardly extending rod 82 which enters into an opening in toggle member 68 to allow movement of toggle member 68 to act on upper pivot member 78 to toggle or pivot upper pivot member 78 about upper pivot pin 74. Lower pivot member 80 has a downwardly extending rounded end 84 which engages the reversing gear plate to toggle the gear plate back and forth to shift or reverse rotary drive 12.

The facing surfaces of the upper and lower pivot members 78 and 80 include facing dowels 86 on which the ends of a typical compression spring 88 are received. Thus, when upper pivot member 78 is toggled by movement of toggle member 68, upper pivot member 78 will eventually pivot. As upper pivot member 78 passes over the center of upper pivot pin 74, upper pivot member 78 acts on the top end of compression spring 88, eventually causing spring 88 to flip or buckle over between its two oppositely buckled, stable position. FIG. 26 shows spring 88 in one of its two buckled stable positions. As spring 88 buckles, the buckling action of spring 88 will pivot or toggle lower pivot member 80 about lower pivot pin 76, thereby acting on the reversing gear plate to shift or reverse the direction of rotary drive 12.

In U.S. Pat. No. 5,673,855, previously referred to above, the buckling spring was a leaf type spring. Buckling spring assembly 70 disclosed herein, including the use of a simple compression spring 88 mounted between rotatable pivot members 78 and 80, is easier to manufacture, more reliable and less costly than the previously used leaf type spring.

Arc Adjustment and Part Circle Operation

The Toggle Assemble

Figure 8:
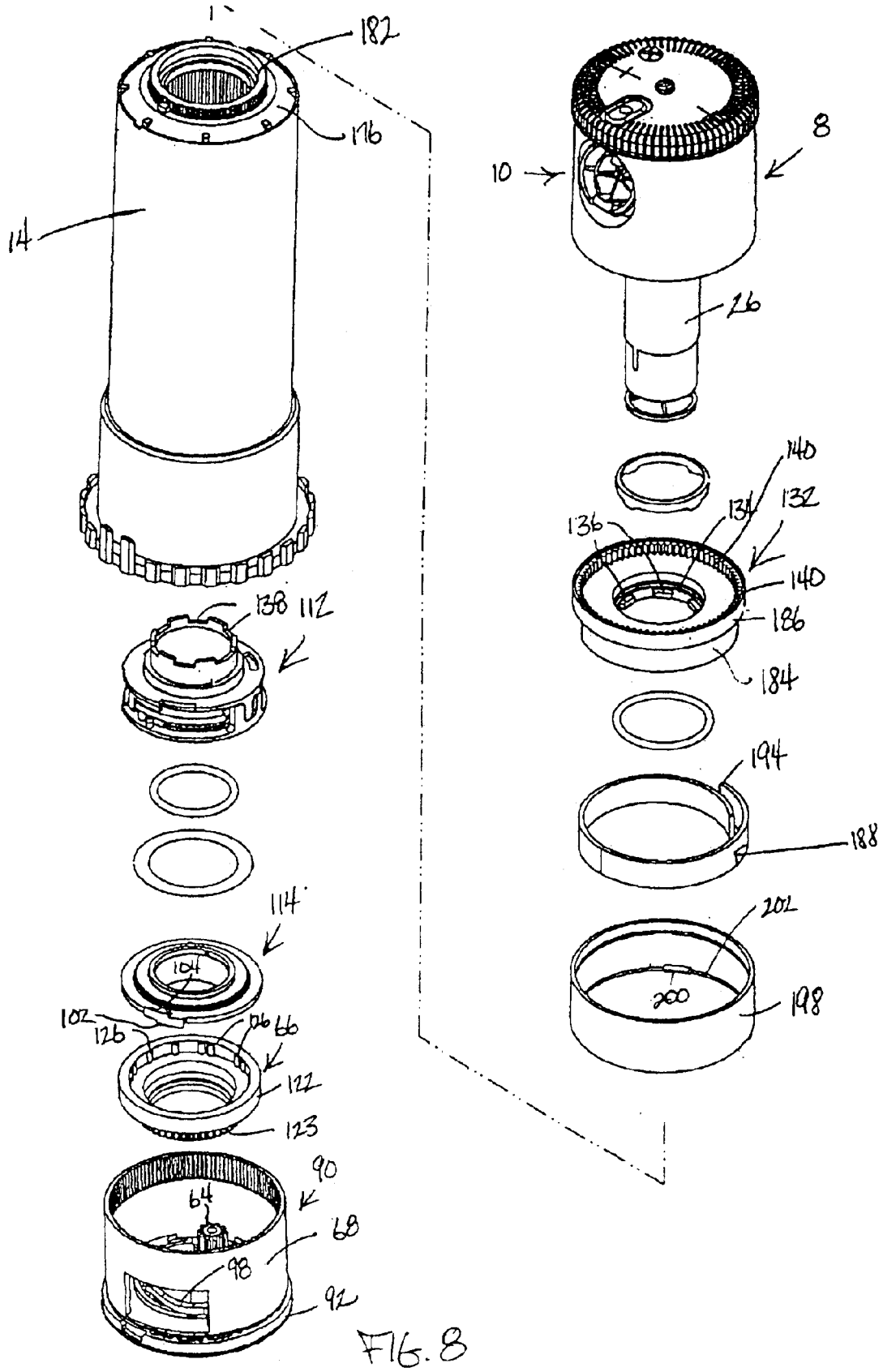
FIG. 8 is an exploded perspective view of some portions of the riser of the sprinkler shown in FIG. 1, particularly illustrating the arc adjustment member and the arc indicator beneath the nozzle assembly on the right side of the drawing and the adjustable stop assembly, the trip plate, the bull gear and the toggle assembly beneath the riser housing on the left side of the drawing.
Figure 19:
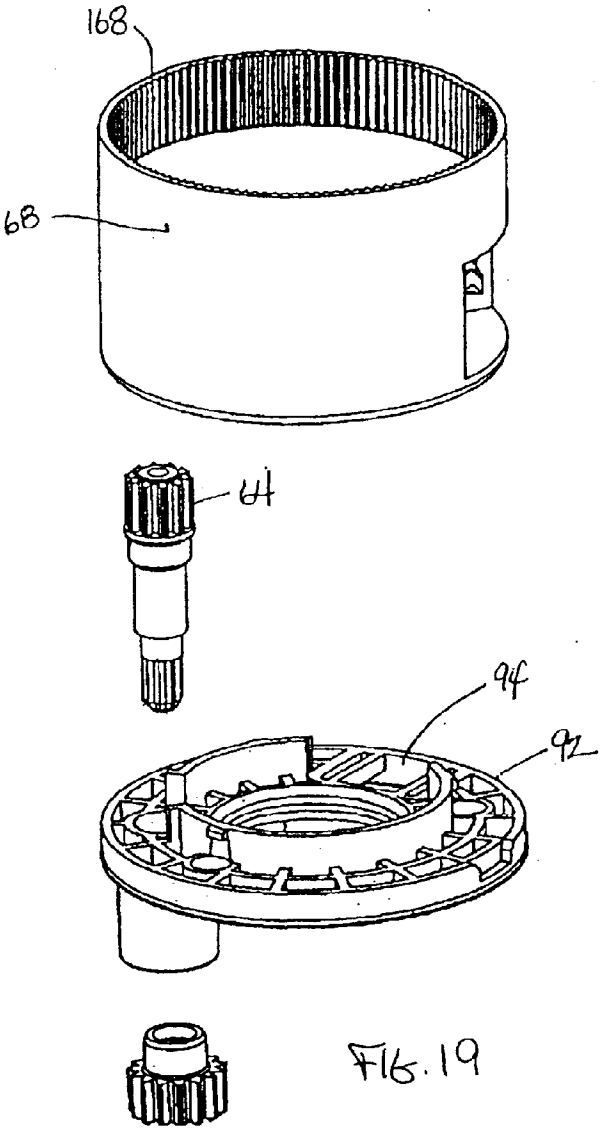
FIG. 19 is an exploded perspective view of the toggle assembly shown in FIG. 8.
Figure 18:
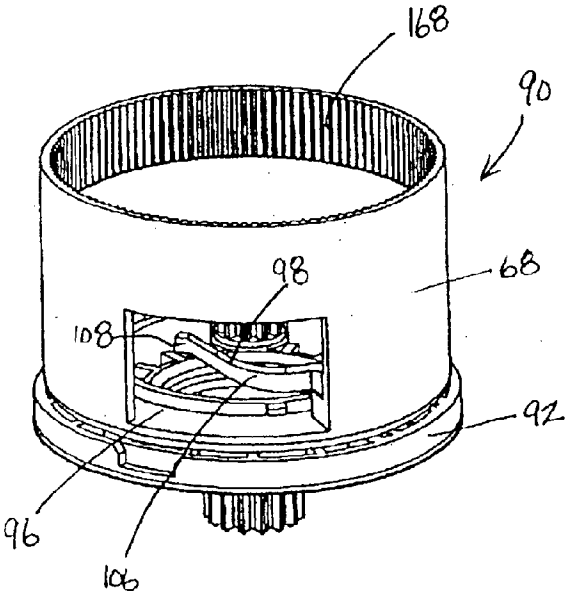
FIG. 18 is a perspective view of the toggle assembly shown in FIG. 8.

Referring now to FIGS. 8, 18 and 19, a toggle assembly 90 includes a toggle base 92 that is fixed inside drive housing 14 to form a support for shiftable toggle member 68. Toggle member 68 is cylindrically shaped and sits on top of toggle base 92, moving slightly back and forth on toggle base 92 as toggle member 68 is toggled. The upwardly extending rod 82 on upper pivot member 78 of buckling spring assembly 70 extends up through a wide aperture 94 in toggle base 92 into a hole on a lower rim or flange 96 of toggle member 68. In addition, output gear 64 of rotary drive 12 is located within cylindrical toggle member 68 to allow output gear 64 to engage bull gear 66. Bull gear 66 is not shown in FIGS. 18 and 19 but is shown in FIG. 8.

Figure 10:
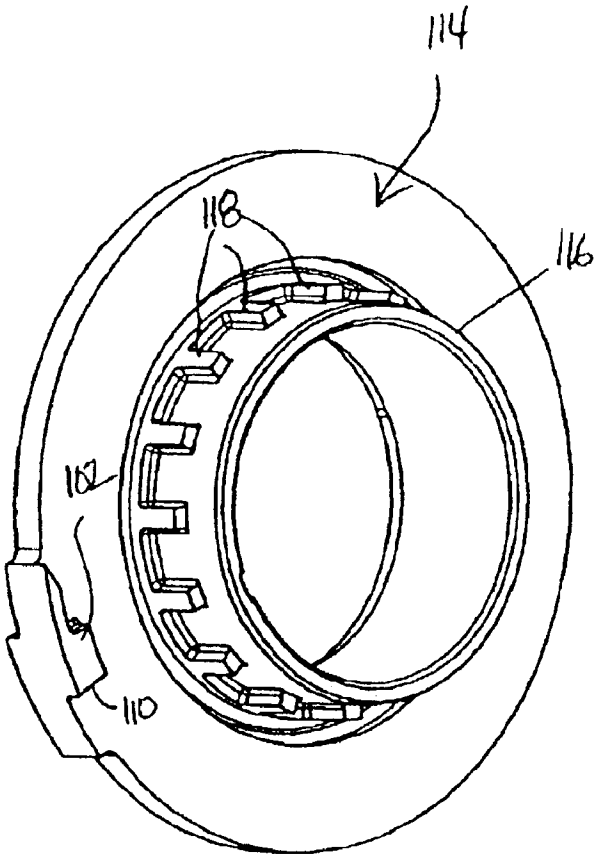
FIG. 10 is a perspective view of the trip plate shown in FIG. 8 looking up at the trip plate.
Figure 9:
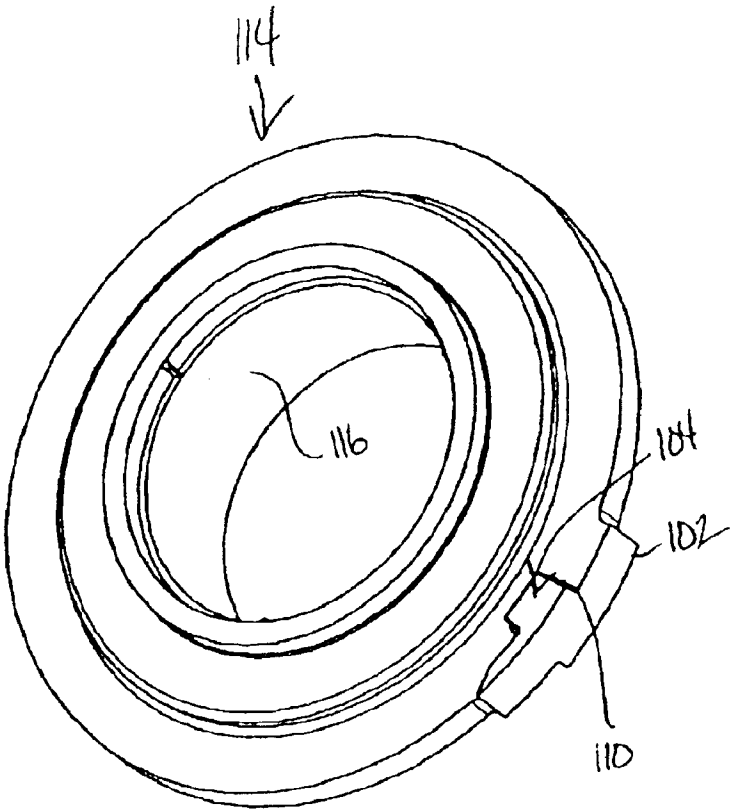
FIG. 9 is a perspective view of the trip plate shown in FIG. 8 looking down at the trip plate.
Figure 13:
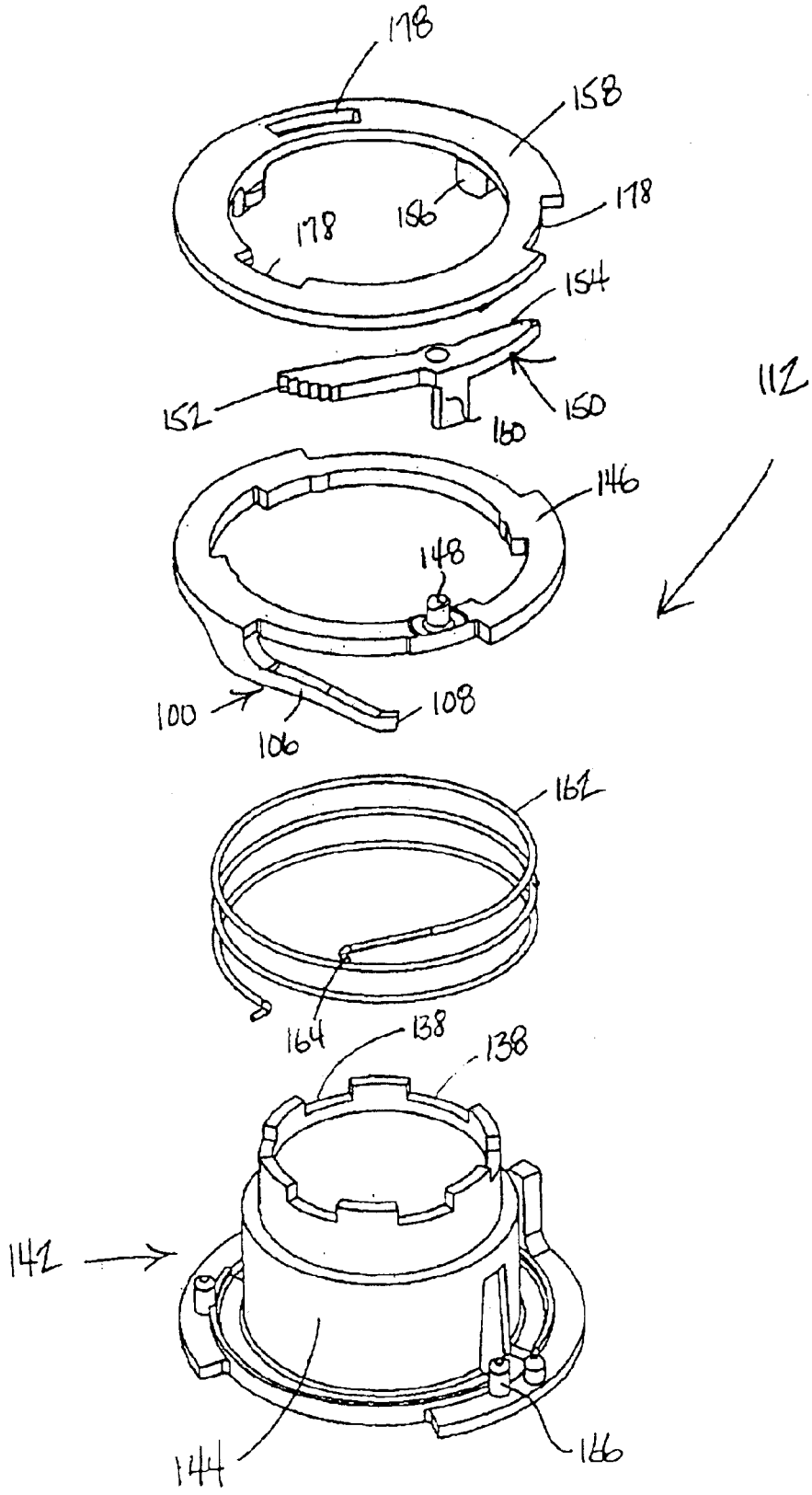
FIG. 13 is an exploded perspective view of the adjustable stop assembly shown in FIG. 8.

First and second arc limit stops 98 and 100 are provided which coact with first and second trip tabs 102 and 104 to toggle or shift toggle member 68 back and forth between the two positions of toggle member 68. Trip tabs 102 and 104 are shown in FIGS. 9 and 10. Each arc limit stop 98 and 100 comprises a flexible ramp shaped arm 106 having a free outer end 108 that normally engages against a flattened surface 110 on one trip tab 102 or 104. As shown in FIG. 18, first arc limit stop 98, comprising an upwardly extending ramp shaped arm 106, is fixed on toggle member 68. As shown in FIG. 13, second arc limit stop 100, comprising a downwardly extending ramp shaped arm 106, is carried on an adjustable stop assembly 112, to be described hereafter.

Before describing the structure of adjustable stop assembly 112, the structure and location of trip tabs 102 and 104 and how they interact with first and second arc limit stops 98 and 100 will be described.

The Trip Plate

Referring again to FIGS. 9 and 10, an annular trip plate 114 has a central hub 116 which is fixedly attached to the downwardly extending water supply tube 26 of nozzle assembly 8. This fixed attachment between annular trip plate 114 and nozzle assembly 8 can be made by any suitable method, i.e. by sonic welding the inner diameter of hub 116 of annular trip plate 114 to water supply tube 26 of nozzle assembly 8. The outer diameter of hub 116 carries a set of vertical drive teeth 118. Torque is transferred to trip plate 114 from rotary drive 12 by a friction clutch 120 interposed between rotary drive 12 and the vertical drive teeth 118 on trip plate hub 116. Thus, the entire nozzle assembly 8 is driven by virtue of the rotary torque applied to trip plate 114 and by the fixed, non-rotary attachment of trip plate 114 to nozzle assembly 8.

Referring to FIG. 8 and again to FIGS. 9 and 10, trip plate 114 carries first and second trip tabs 102 and 104 for engagement by first and second arc limit stops 98 and 100. Trip tabs 102 and 104 comprise solid abutments integrally formed or molded on trip plate 114. First trip tab 102 extends downwardly from trip plate 114 to be engaged by first upwardly extending arc limit stop 98. Second trip tab 104 extends upwardly from trip plate 114 to be engaged by the second downwardly extending arc limit stop 100. Arc limit stops 98 and 100 and trip tabs 102 and 104 are configured so that one stop will engage against one trip tab, respectively, at the end of the selected arc of rotation when nozzle assembly 8 is moving in one direction while the other stop will engage against the other trip tab at the opposite end of the arc when nozzle assembly 8 is moving in the opposite direction. It is the engagement of each trip tab 102 and 104 with its corresponding arc limit stop 98 and 100 that shifts toggle member 68, and hence toggles buckling spring assembly 70 to shift the reversing gear plate, to cause reversal of rotary drive 12.

As noted earlier, each arc limit stop 98 or 100 comprises a flexible ramp shaped arm 106 having a free outer end 108 that normally engages against a flattened surface 110 on trip tab 102 or 104. During normal operation of sprinkler 2, the engagement of each stop with the trip tab effects drive reversal as noted above. However, in the case of forced nozzle rotation tending to drive the arc limit stop past the trip tab, the flexibility of arm 106 comprising the arc limit stop allows the arm to deflect past the trip tab without breaking either the arc limit stop or the trip tab. Then, when sprinkler 2 drive resumes, the arc limit stop can reset itself in relation to the trip tab, i.e. the arc limit stop can pass back past the trip tab into the desired position, without retripping toggle member 68. Again, arc limit stops and trip tabs which are shaped and which function in this manner are disclosed in U.S. Pat. No. 4,972,993, which is also incorporated by reference herein.

The Arc Adjustment

Figure 7:
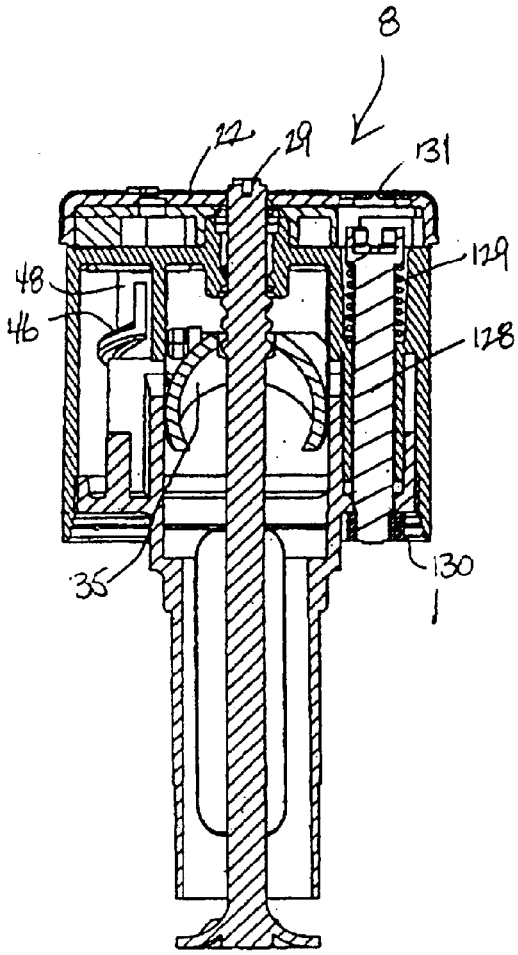
FIG. 7 is a cross-sectional view of the nozzle assembly shown in FIGS. 4 and 5, particularly illustrating the pivotal nozzle from the rear thereof and showing both the trajectory setting and arc setting shafts used to adjust the trajectory and the arc of rotation, respectively.

As noted earlier, the distance between the two arc limit stops 98 and 100 is adjustable to allow the user to set or adjust the arc of oscillation to any desired value. Referring to FIGS. 3 and 7, nozzle assembly 8 carries a selectively adjustable arc setting shaft 128 that can be manipulated by the user to adjust the arc of rotation of sprinkler 2 by rotating the adjustable arc limit stop. Arc setting shaft 128 runs vertically in a position that is off-set from the center of nozzle assembly 8, has an upper end that is closely adjacent the top of nozzle assembly 8 to allow arc setting shaft 128 to be operated from above nozzle assembly 8, and has a gear 130 located on its lower end. The upper end of arc setting shaft 128 can be accessed by inserting a tool through a hole or slit 131 provided in rubber cover 22 overlying arc setting shaft 128. Arc setting shaft 128 is normally spring biased upwardly with gear 130 being located within the bottom of nozzle assembly 8.

An arc adjustment member 132 is carried immediately below nozzle assembly 8 on top of the non-rotatable drive housing 114 of riser 4. Arc adjustment member 132 has a central inner hub 134 that has a plurality of inwardly extending teeth 136 which interfit into a plurality of upwardly extending notches 138 on adjustable stop assembly 112. See FIG. 8. This interfitting tooth/notch structure non-rotatably couples arc adjustment member 132 to adjustable stop assembly 112. In other words, when arc adjustment member 132 is rotated relative to drive housing 14, adjustable stop assembly 112 is carried with it to be similarly rotated, thereby moving adjustable arc limit stop 100 carried on adjustable stop assembly 112 towards or away from fixed arc limit stop 98.

Figure 29:
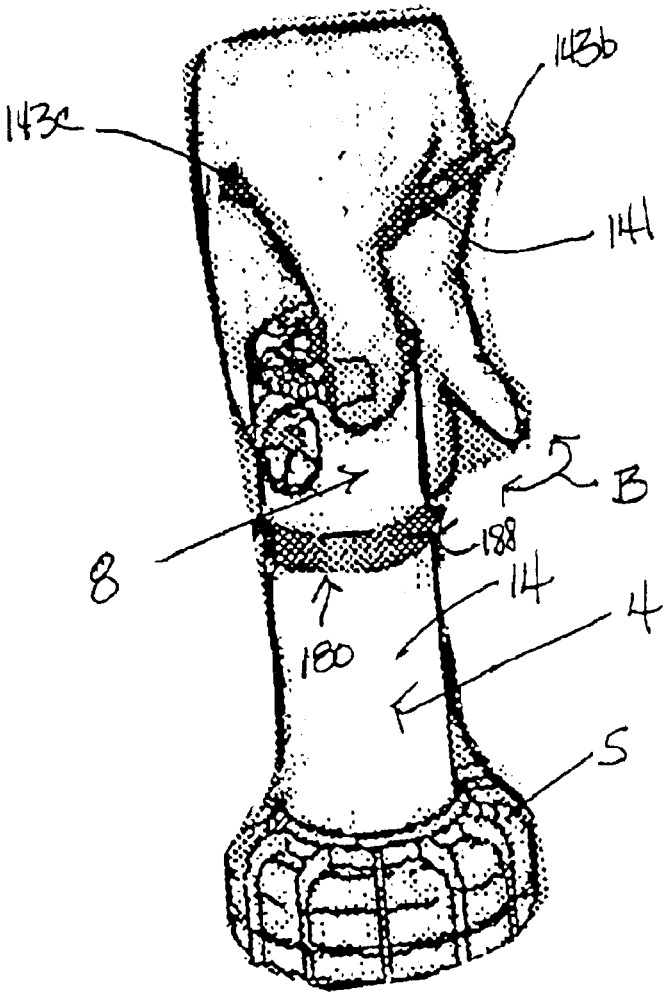
FIG. 29 is a perspective view of one hand of a user using a tool to push down on arc setting shaft while the user's hand grips the nozzle assembly during an arc adjustment operation.
Figure 30:
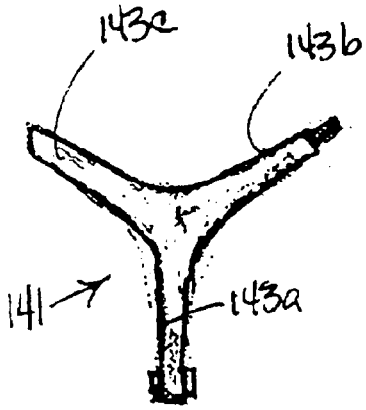
FIG. 30 is a side elevational view of the tool shown in FIG. 29.

To adjust the arc, the user pushes down on arc setting shaft 128 against the bias of the spring 129 that acts on shaft 128. This lowers gear 130 on arc setting shaft 128 out of nozzle assembly 8 and into engagement with an internal ring gear 140 carried on arc adjustment member 132. This couples or locks nozzle assembly 8 to arc adjustment member 132. Referring now to FIGS. 29 and 30, to keep nozzle assembly 8 locked to arc adjustment member 132, the user can hold arc setting shaft 128 down in this lowered position using a saddle shaped tool 141 having three stems 143*a–c*. One stem of this tool can be inserted into the top of arc setting shaft 128, this stem 143*a* extending vertically in FIG. 29 and being hidden by the user's thumb in FIG. 29 with the saddle formed between the other two stems 143*b* and 143*c* facing upwardly. As shown in FIG. 29, the edge of the palm of one of the user's hands can rest against the saddle formed by stems 143*b* and 143*c* of tool 141 while the user grabs nozzle assembly 8 with the thumb and some of the fingers of the same hand.

After arc setting shaft 128 is moved down into engagement with arc adjustment member 132 and is held there, the user can then rotate nozzle assembly 8 in one direction or the other using the hand that grips nozzle assembly 8. Drive housing 14 will remain stationary as it is keyed or splined to sprinkler body 6 which itself is non-rotatable since sprinkler body 6 is buried in the ground and non-rotatably installed on irrigation piping. The rotation of nozzle assembly 8 relative to drive housing 14 is effectively coupled to arc adjustment member 132 through the interconnection of arc setting shaft 128, more specifically through the interconnection of gear 130 on arc setting shaft 128 to ring gear 140 on arc adjustment member 132, to thereby rotate arc adjustment member 132 and, thus, adjustable arc limit stop 100. When adjustable arc limit stop 100 reaches a new desired position, the user can let up on arc setting shaft 128 by releasing pressure from tool 141, thereby letting spring 129 move gear 130 on arc setting shaft 128 back up and out of engagement with ring gear 140 on arc adjustment member 132 and into nozzle assembly 8.

Saddle shaped tool 141 can have some of the stems 143 thereon differently shaped to engage with different ones of the adjustable components on sprinkler 2. Thus, as shown in FIG. 29, one stem 143*a* can be specially shaped to engage with the upper end of arc setting shaft 128. Some of the other stems 143*b* or 143*c* can be formed with screwdriver like blades or ends shaped to engage with the top of trajectory setting shaft 48, with the opening 29 in the top of flow shut off shaft 32, and/or with the top of radius adjustment screw 42. Alternatively, separate tools could be provided for each adjustment operation, though the use of a tool 141 with an upwardly facing saddle is useful during the arc adjustment operation as described above as it allows a place for the edge of the user's palm to rest as the user pushes down on the tool and grips nozzle assembly 8.

Instead of the arc adjustment operation described above, the arc can also be adjusted simply by pushing down on arc setting shaft 128 using stem 143*a* of tool 141 and by then rotating tool 141. This will rotate gear 130 on the end of arc setting shaft 128 to rotate arc adjustment member 132. In this mode of adjustment, the user simply needs to rotate tool 141 with one hand while holding nozzle assembly 8 steady with the user's other hand. However, whichever mode of adjustment is used, the net result is rotation of arc adjustment member 132 to rotate adjustable arc limit stop 100 relative to fixed arc limit stop 98.

Structure similar to the above described arc setting shaft and ring gear on an arc adjustment member is shown and described more fully in U.S. Pat. No. 5,695,123, assigned to the assignee of this invention, which is also incorporated by reference.

The Adjustable Stop Assembly

Adjustable stop assembly 112 has two purposes. The first purpose is to allow second arc limit stop 100 to be circumferentially moved towards or away from first arc limit stop 98 to adjust the arc of rotation provided by rotary drive 12. When the free outer ends 108 of the arms 106 that form arc limit stops 98 and 100 are separated a proper amount, then rotary drive 12 provides 90° of rotation before reversing. If second arc limit stop 100 is moved another 90° away from first arc limit stop 98, then rotary drive 12 provides 180° of rotation before reversing. Similarly, moving second arc limit stop 100 towards first arc limit stop 98 will decrease the arc of rotation from its previous setting. Thus, the user can select a desired arc of rotation of rotary drive 12, and hence the arc segment watered by sprinkler 2, by appropriate adjustment of the second movable arc limit stop 100 towards or away from first arc limit stop 98.

As will be described in more detail hereafter in the section entitled Full Circle Operation, the second purpose of adjustable stop assembly 112 is to convert the rotation of nozzle assembly 8 from oscillating, part circle rotation (rotation in arcs less than 360°) to unidirectional, full circle rotation (rotation of nozzle assembly 8 through a complete circle of 360°). It is advantageous when watering a full circle to do so with a rotary drive 12 that rotates unidirectionally around and around in complete circles rather than with a drive that oscillates back and forth through 360°. In the latter case of an oscillating drive that reverses the direction of rotation when the arc of rotation reaches 360°, the arc setting is seldom exactly perfect such that the actual arc of rotation might be slightly less or more than 360°. If the arc setting is slightly less than 360°, there will be a wedge of ground or turf that will be unwatered. If the arc setting is slightly more than 360°, there will be a wedge of ground or turf that is double watered compared to the rest of the pattern. Sprinkler 2 of this invention avoids these problems by permitting rotary drive 12 to rotate unidirectionally without reversing itself when second arc limit stop 100 is positioned for full circle or 360° rotation.

Adjustable stop assembly 112 includes a base 142 having a central hub 144 which carries the upwardly extending notches 138 used to couple stop assembly 112 to arc adjustment member 132. Adjustable arc limit stop 100 is carried on an annular stop plate 146, the arm 106 forming adjustable arc limit stop 100 extending downwardly from stop plate 146. Stop plate 146 includes an upwardly extending pivot pin 148 on which a pawl 150 is pivotally carried. Pawl 150 has a toothed end 152 that is used during drive reversal to toggle or shift toggle member 68. The other end of pawl 150 is located on the opposite side of pivot pin 148 and includes a cam surface 154 that interacts with a cam 156 carried on an overlying full circle ring 158. Pawl 150 includes a downwardly extending finger 160.

Figure 15A:
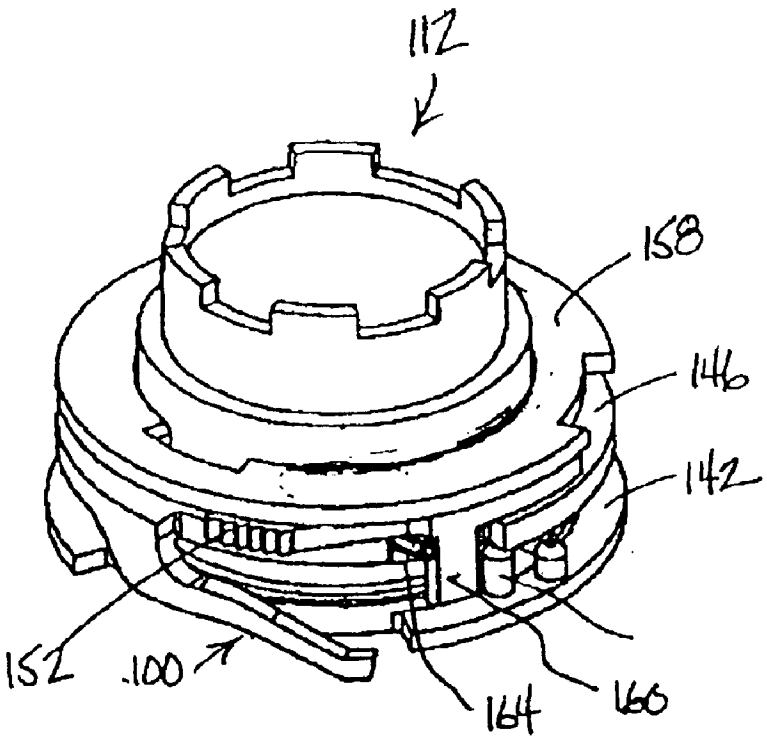
FIG. 15 is a perspective view, similar to FIG. 14, of the other side of the adjustable stop assembly shown in FIG. 14, particularly illustrating the adjustable arc limit stop.

A torsion spring 162 surrounds central hub 144 of base 142 and has its lower end fixed to base 142. The upper end 164 of torsion spring 162 extends radially outwardly and is engaged against one side of finger 160 on pawl 150. Spring 162 is arranged so that the torsional force of spring 162 acting against finger 160 on pawl 150 tends to move adjustable arc limit stop 100 into its normal operational position awaiting contact from its corresponding trip tab. This position is shown in FIGS. 15 and 16.

Figure 16:
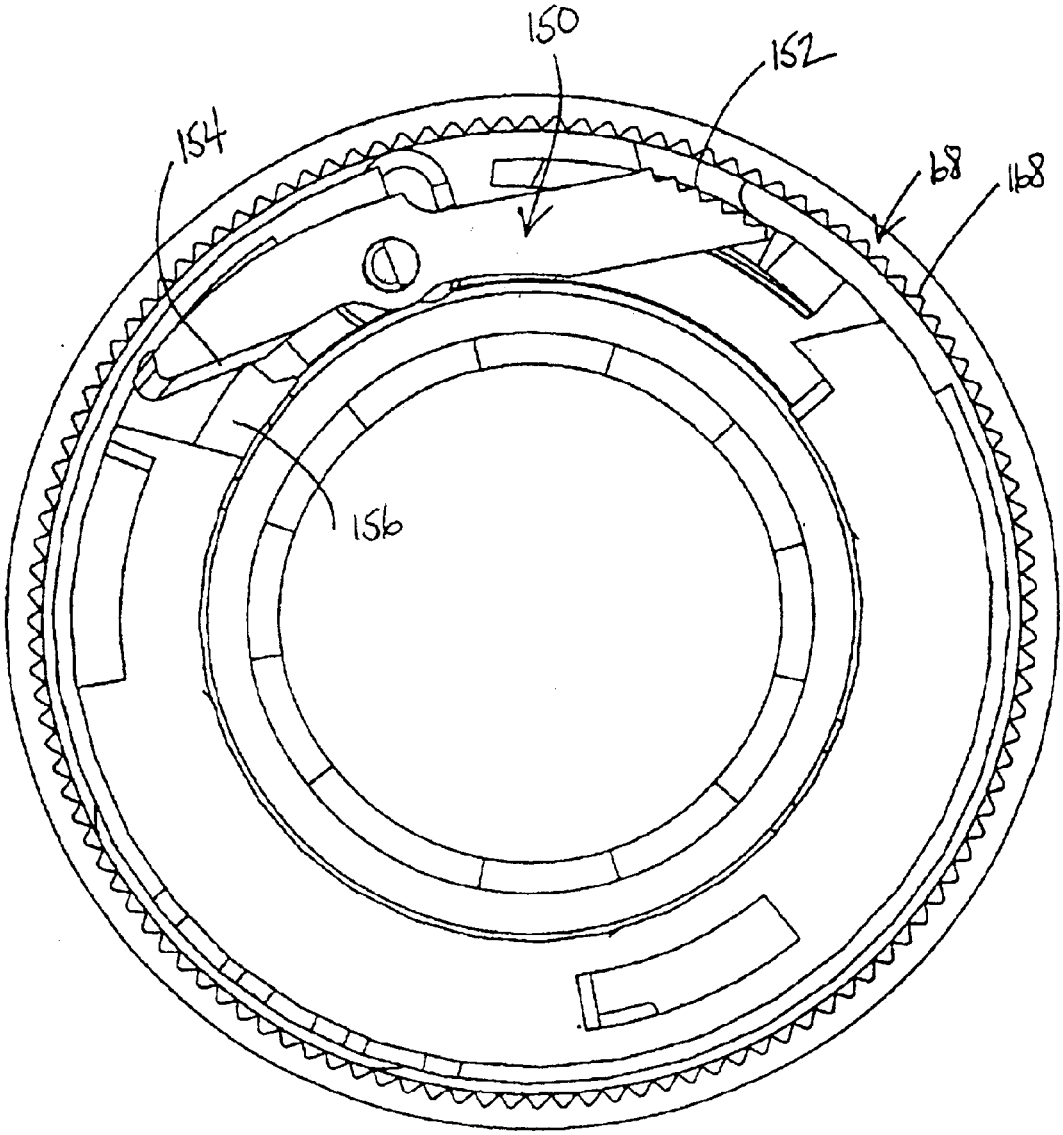
FIG. 16 is a top plan view of a portion of the adjustable stop assembly shown in FIG. 8, particularly illustrating the pivotal pawl of the adjustable stop assembly being pivoted inwardly relative to the stop assembly to be disengaged from the toggle member of the toggle assembly.

As shown in FIG. 16, in the normal operational position of adjustable arc limit stop 100, pawl 150 is pivoted about its pivot axis such that the toothed end 152 of pawl 150 is radially retracted inwardly relative to stop assembly 112. This occurs due to cam 156 carried on the overlying full circle ring 158. Cam 156 will engage with cam surface 154 on the other end of pawl 150 and will rotate pawl 150 in a clockwise direction about its pivot axis. When adjustable arc limit stop 100 has not yet been engaged by its trip tab with the components of adjustable stop assembly 112 positioned as shown in FIG. 15, cam 156 on full circle ring 158 holds pawl 150 in the retracted position of FIG. 16 with toothed end 152 of pawl 150 being swung radially inwardly relative to the outer diameter of stop assembly 112.

When trip tab 104 approaches and engages against the flattened outer end 108 of adjustable arc limit stop 100, trip tab 104 begins to push on stop 100, thereby rotating stop plate 146 carrying stop 100 relative to base 142. This carries pawl 150 with stop plate 146 as pawl 150 is connected to pivot pin 148 carried on stop plate 146. As pawl 150 moves with stop plate 146, cam surface 154 on the rear end of pawl 150 moves away from and eventually disengages cam 156 on full circle ring 158. As soon as this occurs, the torsional force of spring 162 is free to act against finger 160 of pawl 150 to cause pawl 150 to pivot in a counter-clockwise direction about pivot pin 148, thereby swinging toothed end 152 of pawl 150 radially outwardly past the outer diameter of stop plate 146. The net result of trip tab 104 engaging arc limit stop 100 carried on stop plate 146 is to rotate stop plate 146 and cause toothed end 152 of pawl 150 to move out from the side of adjustable stop assembly 112.

Figure 17:
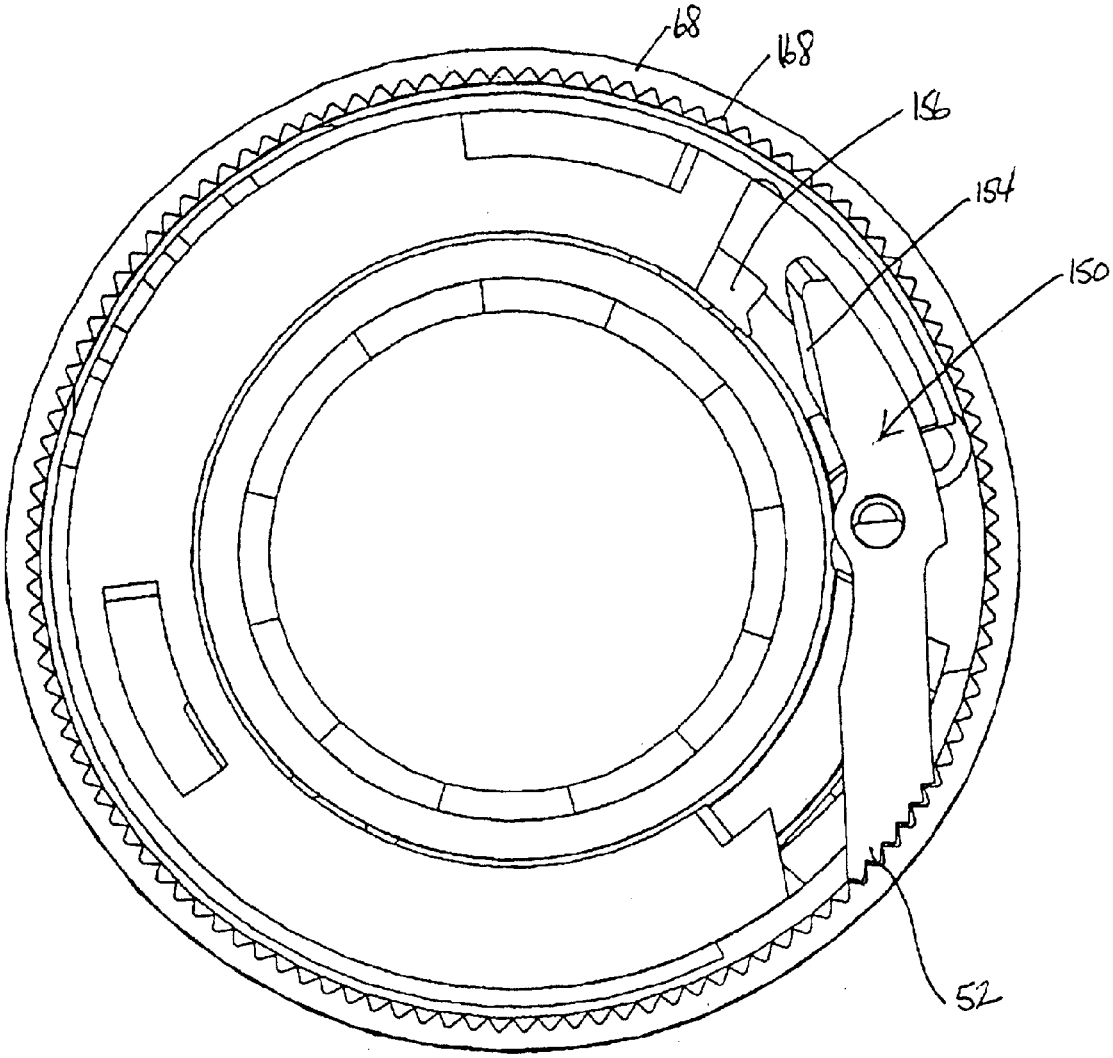
FIG. 17 is a top plan view, similar to FIG. 16, of a portion of the adjustable stop assembly shown in FIG. 8, particularly illustrating the pivotal pawl of the adjustable stop assembly being pivoted outwardly relative to the stop assembly to be engaged with the toggle member of the toggle assembly during a drive reversal operation.

As shown in FIG. 17, when toothed end 152 of pawl 150 swings out relative to adjustable stop assembly 112, it engages against various serrations in a serrated ring 168 carried at the top of the inside diameter of toggle member 68. Thus, the next bit of movement of adjustable arc limit stop 100 as it is being pushed by trip tab 104 is now coupled, through pawl 150, to toggle member 68 to rotate toggle member 68 in the appropriate direction to reverse rotary drive 12. As soon as rotary drive 12 reverses, trip tab 104 begins moving away from adjustable arc limit stop 100, thus allowing torsion spring 162 to begin pushing stop plate 146 back towards its normal operational position. As stop plate 146 moves back to this normal operational position, cam 156 on full circle ring 158 eventually engages cam surface 154 on the rear end of pawl 150 to pivot pawl 150 in a clockwise direction and thereby retract pawl 150 back into the outer diameter of stop assembly 112.

Thus, to summarize this portion of operation of adjustable stop assembly 112, stop assembly 112 carries adjustable arc limit stop 100 and is configured with a pivotal toothed pawl 150 that is normally retracted into stop assembly 112 when adjustable arc limit stop 100 is not being engaged by its trip tab 104. In this condition, there is no connection between stop assembly 112 and toggle member 68 carrying the fixed or non-adjustable arc limit stop 98. Thus, when stop assembly 112 is itself rotated in the arc adjustment procedure described above, it does not carry with it toggle member 68 such that the distance between the adjustable and non-adjustable arc limit stops 100 and 98 actually changes. If pawl 150 were constantly in engagement with toggle member 68, then no arc adjustment would occur since the rotation of stop assembly 112 would be transmitted to toggle member 68 as well, thereby not allowing relative movement between the two arc limit stops.

However, adjustable arc limit stop 100 must be coupled to toggle member 68 during the moment of desired drive reversal to toggle or shift toggle member 68 in one direction. That is why toothed pawl 150 is extended outwardly from stop assembly 112 as described above as trip tab 104 engages and pushes against adjustable arc limit stop 100. This movement of pawl 150 is for the purpose of coupling adjustable arc limit stop 100 to toggle member 68 during drive reversal, to allow further movement of adjustable arc limit stop 100 to be transferred to toggle member 68 to toggle or shift toggle member 68 in the appropriate direction.

Pawl 150 is needed only for drive reversal at one end of the arc of rotation since the other non-adjustable arc limit stop 98 is fixedly connected to toggle member 68 itself. Thus, when the other trip tab 102 engages and pushes against this fixed arc limit stop 98, it can toggle or shift toggle member 68 in the other direction without the need for any such pawl 150.

The Friction Clutch

Figure 12:
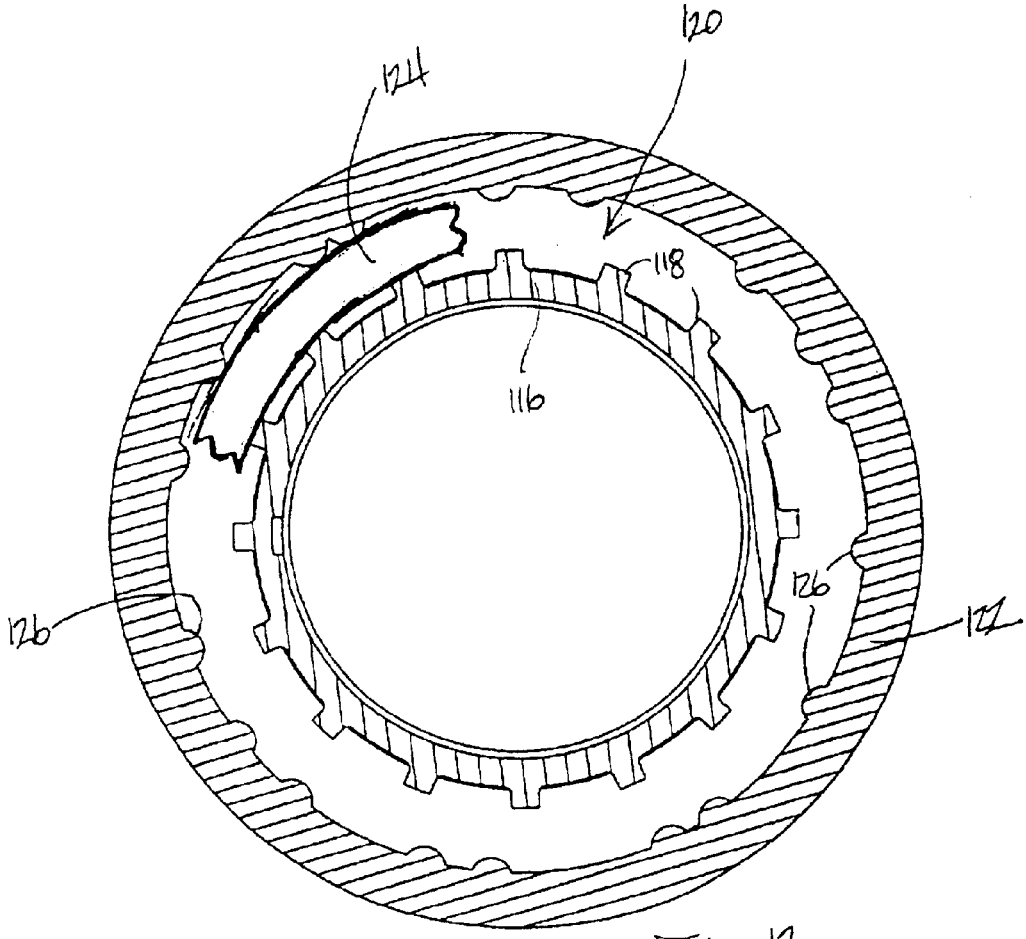
FIG. 12 is a cross-sectional view through the clutch hub on the bull gear and the trip plate illustrating the friction clutch between the bull gear and the trip plate.
Figure 11:
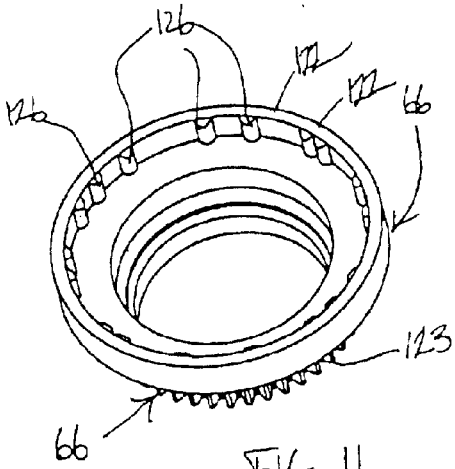
FIG. 11 is a perspective view of the bull gear shown in FIG. 8, particularly illustrating the clutch hub thereon for transferring torque to the trip plate, and thus, to the nozzle assembly.

Referring now to FIGS. 11 and 12, bull gear 66 is integrally formed with a short, cylindrically shaped clutch hub 122 extending above the teeth 123 of bull gear 66. Clutch hub 122 concentrically surrounds central hub 116 of trip plate 114. A circular, friction clutch member 124, such as an elastomeric O-ring, is sized to be pressed between clutch hub 122, and more specifically between a plurality of inwardly extending ribs 126 on clutch hub 122, and vertical drive teeth 118 on hub 116 of trip plate 114. The amount of force or pressure exerted by O-ring 124 on drive teeth 118 is chosen to provide a driving connection between bull gear 66 and trip plate 114 during normal operation of sprinkler 2. However, if a user or vandal should grab nozzle assembly 8 and manually turn nozzle assembly 8 back and forth with more force than is normally exerted by rotary drive 12, friction clutch 120 is designed to slip to allow faster rotation between nozzle assembly 8 and rotary drive 12. This prevents damage to rotary drive 12 during such periods of forced nozzle rotation.

Vertical drive teeth 118 on the hub 116 of trip plate 114 are spaced generally equally around the circumference of central hub 116. However, the radially inwardly protruding ribs 126 on the inner diameter of clutch hub 122 are not equally spaced, but instead have a non-symmetrical spacing around the inner diameter of clutch hub 122, as best shown in FIG. 12. This non-symmetrical spacing of ribs 126 helps prevent clutch member 124, i.e. the O-ring, from feeling bumpy during manual advancement of nozzle assembly 8. Thus, if a user manually rotates nozzle assembly 8 in one direction or the other, friction clutch 120 will provide a smoother feel to the user. Accordingly, the non-symmetrical spacing of ribs 126 on clutch hub 122 relative to the symmetrical drive teeth 118 on trip plate 114 is preferred over a configuration where both ribs 126 and drive teeth 118 are symmetrical relative to one another.

Friction clutch 120 has two desired operational characteristics. The first is that it provide adequate driving torque through the clutch, namely that it rotate nozzle assembly 8 without slipping during the normal operation of sprinkler 2. Sprinkler 2 shown herein nominally needs approximately 2 inch pounds of force through friction clutch 120 to be properly driven. Thus, taking manufacturing tolerances and variable environmental conditions into account, both of which can increase the force needed to drive nozzle assembly 8 from the nominal value of 2 inch pounds, friction clutch 120 is designed not to slip through approximately 3 to 4 inch pounds of force.

The second desirable characteristic of friction clutch 120 is that it provide slipping during manual advancement of nozzle assembly 8 by a user. There will be times when a user might wish to manually advance nozzle assembly 8 by overcoming friction clutch 120, such as to manually advance rotary drive 12 to a reversal point or for other reasons. Desirably, friction clutch 120 should not be so stiff as to make it very hard for a user to manually advance nozzle assembly 8. Thus, friction clutch 120 should slip at some higher level of force. In the case of sprinkler 2 shown herein, friction clutch 120 is configured to desirably slip whenever the user applies at least approximately 6 inch pounds of force. Thus, to recapitulate, friction clutch 120 is designed not to slip below approximately 3 to 4 inch pounds of force, but to slip above approximately 6 inch pounds of force.

The Applicants originally used a dry, non-lubricated O-ring 124 and configured the interference fit on O-ring 124 provided by ribs 126 and teeth 118 to provide a friction clutch 120 that met the two characteristics set forth above. However, in testing sprinklers 2 built with a friction clutch 120 of the type disclosed herein, the Applicants found that contaminants in the water, such as oil or algae, would loosen the interference fit so much that some sprinklers 2 would no longer be properly driven. In other words, these sprinklers would slip below approximately 3 to 4 inch pounds of force.

To overcome this problem, the Applicants devised the concept of first lubricating O-ring 124 by immersing such O-ring in a lubricating oil or grease of the same general type as is used by the assignee to lubricate rotary drives in its golf sprinklers. This is a lubricating oil having a high viscosity index as shown in the following table:

| | CST | SUS |
|---|---|---|
| 100° F. | 54–58 | 234–258 |
| 210° F. | 10–11.5 | 49.7–54.9 |

Then, the interference fit on O-ring 124 provided by ribs 126 and teeth 118 was adjusted by tightening the fit provided by ribs 126 and teeth 118 so that the above-described two desirable operational characteristics of friction clutch 120 were still achieved, namely of not slipping below approximately 3 to 4 inch pounds of force and of slipping above approximately 6 inch pounds of force. With such a tightened interference fit built into the parts that carry ribs 126 and teeth 118, each sprinkler 2 is then built with an O-ring that has been pre-lubricated using a suitable oil or grease. The Applicants have found that such a sprinkler is thereafter relatively impervious to the effects of contaminants in the water flowing through the sprinkler such that sprinklers built with pre-lubricated O-rings are much less likely to begin to slip due to the effects of such contaminants on the driving force provided by friction clutch 120 than sprinklers built with dry, non-lubricated O-rings.

The example of the oil set forth above herein for use in pre-lubricating O-ring 124 is only one example of an oil that adequately lubricates the O-ring, which in conjunction with a properly designed interference fit as provided by ribs 126 and teeth 118, allows friction clutch 120 to more reliably resist the effects of contaminants in the water. Other specific types of lubricating oils and greases may also be found which would be suitable for pre-lubricating O-ring 124.

Full Circle Operation

Full circle ring 158 has been described above in connection with cam 156 on the underside of ring 158 that acts against pawl 150 to normally keep pawl 150 retracted within stop assembly 112. However, full circle ring 158 is so-named because it comes into play when one adjusts sprinkler 2 to water a full circle, i.e. 360°. That operation will now be described.

Figure 14A:
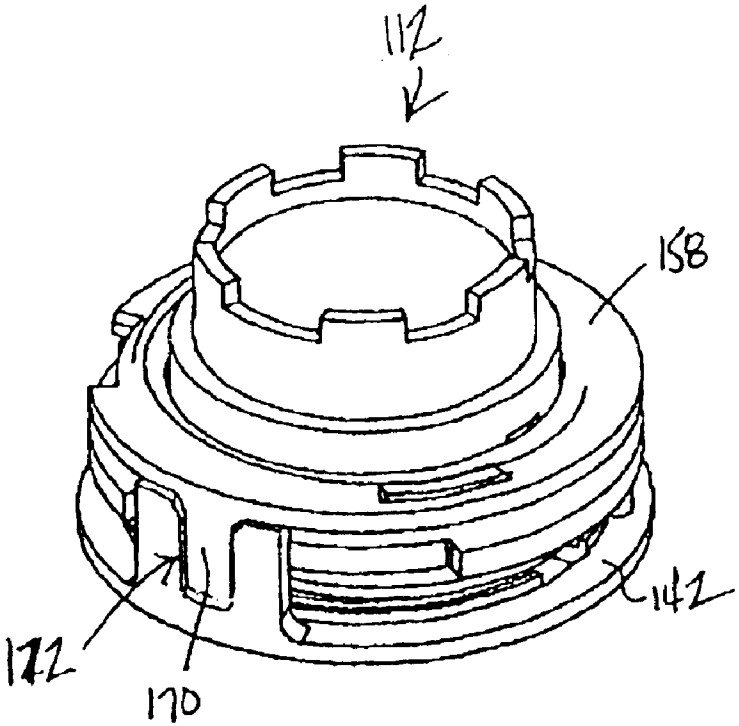
FIG. 14 is a perspective view of one side of the adjustable stop assembly shown in FIG. 8.

As shown in FIG. 14, full circle ring 158 overlies stop plate 146 and has a downwardly extending guide tab 170 received in a U-shaped guide slot 172 on base 142 of stop assembly 112. Full circle ring 158 can move vertically upwardly and downwardly relative to base 142 with guide tab 170 sliding up and down in guide slot 172. Torsion spring 162 also acts as an expansion spring with spring 162 having its lower end bearing against base 142 and its upper end bearing against the underside of stop plate 146. Thus, spring 162 is effective to move stop plate 146, and hence the overlying full circle ring 158, upwardly relative to base 142. Full circle ring 158 is moved upwardly by stop plate 146 due to various downwardly projecting spacers (not shown) bearing against stop plate 146. Such spacers keep full circle ring 158 level relative to stop plate 146 and also let stop plate 146 act on full circle ring 158 to lift full circle ring 158 as stop plate 146 rises under the influence of torsion spring 162 lifting upwardly on stop plate 146.

When sprinkler 2 is in use and is being used for part circle operation, i.e. when the arc of rotation is less than 360°, stop plate 146 and full circle ring 158 are both forced downwardly towards base 142 to axially compress torsion spring 162 somewhat. This occurs because various downwardly extending tabs 174 (shown in FIG. 2) on the underside of an annular horizontal partition 176 at the top of drive housing 14 bear against the top of full circle ring 158 and force such full circle ring 158 and the underlying stop plate 146 downwardly against torsion spring 162. However, as stop assembly 112 is rotated during an arc adjustment operation and as it reaches its full circle or 360° position, these tabs 174 in drive housing 14 become aligned with various cut-outs or notches 178 in full circle ring 158. At this instant, stop plate 146 and full circle ring 158 can move upwardly under the influence of the axial compression in torsion spring 162 with tabs 174 then being received in cut-outs 178 until such time as full circle ring 158 abuts against the same partition 176 that carries tabs 174.

The above-described upward movement of full circle ring 158 and stop plate 146 is selected to be enough to cause adjustable arc limit stop 100 to rise above the plane in which its corresponding trip tab 104 travels. Remember that when torsion spring 162 is axially compressed with tabs 174 pushing down on full circle ring 158, adjustable arc limit stop 100 is at the same vertical level as trip tab 104 so that trip tab 104 will hit adjustable arc limit stop 100 as it is being rotated by rotation of nozzle assembly 8. However, when tabs 174 enter cut-outs 178 in full circle ring 158, the compressed torsion spring 162 expands to lift stop plate 146 and full circle ring 158 enough to lift the free end of adjustable arc limit stop 100 above the path of travel of trip tab 104. Thus, trip tab 104 never hits adjustable arc limit stop 100 after this occurs.

If the rotary drive is toggled so that trip tab 104 is moving towards arc limit stop 100 when conversion to full circle operation occurs, then the sprinkler will keep moving in this same direction and will miss arc limit stop 100 to immediately convert to unidirectional rotation. If the rotary drive is toggled so that trip tab 104 is moving away from arc limit stop 100 when conversion to full circle operation occurs (i.e. trip tab 102 is moving towards arc limit stop 98), then the sprinkler will reverse direction once when trip tab 102 hits arc limit stop 98. Thereafter, the sprinkler will begin unidirectional rotation in the same direction as in the previous example. Accordingly, whether sprinkler 2 immediately begins unidirectional rotation or reverses direction once depending upon which way it was moving immediately prior to conversion to full circle operation, the result is that sprinkler 2 will thereafter operate in its full circle mode by rotating in a unidirectional direction completing one revolution after another without reversing or oscillating again.

This type of full circle operation is preferred over one where sprinkler 2 oscillates back and forth between 360° because it enhances uniform watering, namely there is no strip at the 360° mark that receives more or less water than the rest of the circle. As just noted, conversion to true full circle operation occurs in sprinkler 2 of this invention because of vertical movement of one of arc limit stops 98 and 100 out of the path of movement of its trip tab.

If part circle operation is desired, the user can rotate stop assembly 112 back out of its full circle position. As this occurs, tabs 174 on drive housing partition 176 will engage against the side of cut-outs 178. Tabs 174 can be inclined to exert a camming action to more easily permit full circle ring 158 to be forced beneath tabs 174. As soon as tabs 174 come up out of cut-outs 178 and ride on the top of full circle ring 158, full circle ring 158 and stop plate 146 have been moved down to axially compress torsion spring 162 and to lower adjustable arc limit stop 100 back down into a position where it will be engaged by its trip tab 104. Thus, normal part-circle, oscillating rotation as described above will again occur.

The Arc Indicator

Figure 20:
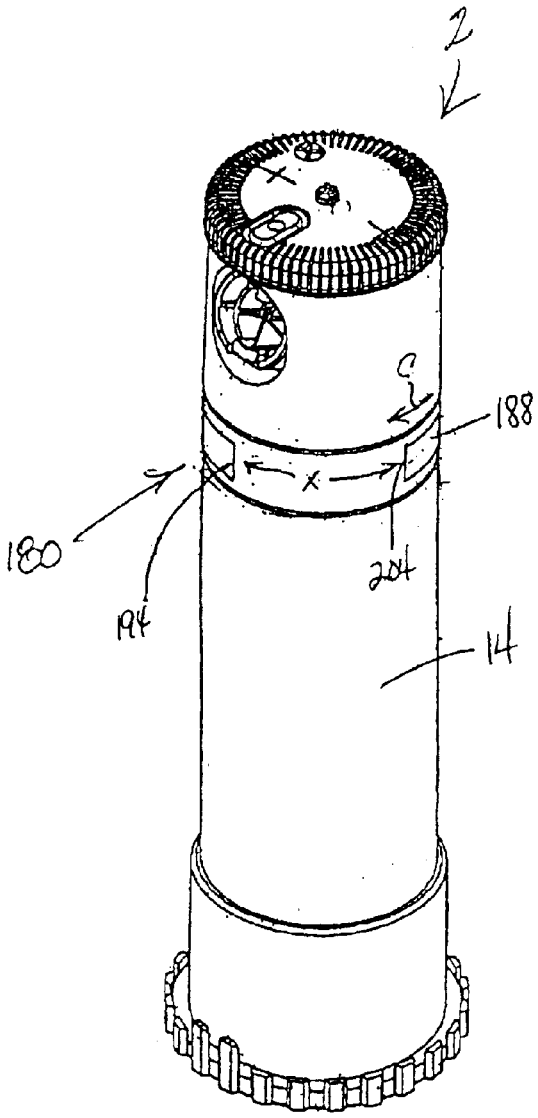
FIG. 20 is a perspective view of the exterior of the sprinkler riser of the sprinkler shown in FIG. 1, particularly illustrating the arc indicator with the arc indicator showing that the sprinkler has been adjusted to water an arc segment of 270°.
Figure 21:
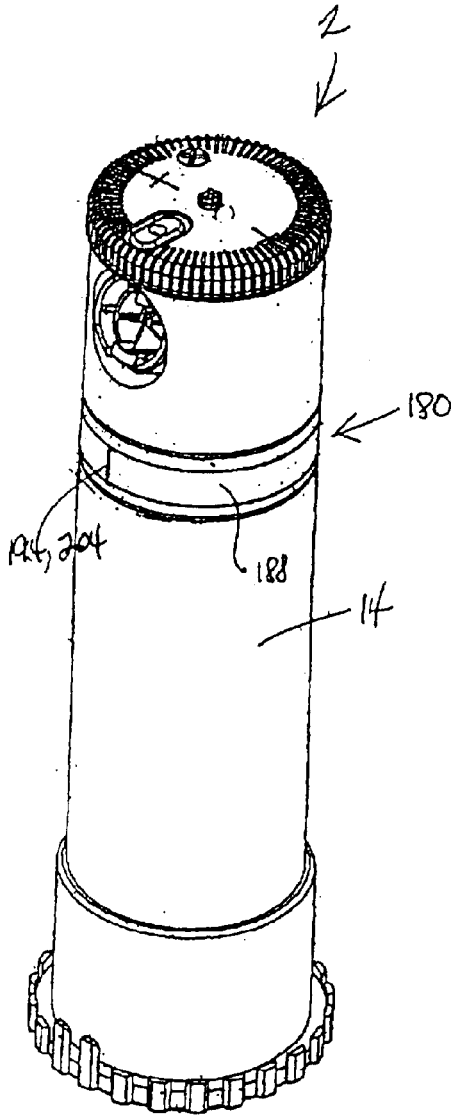
FIG. 21 is a perspective view, similar to FIG. 20, of the exterior of the sprinkler riser of the sprinkler shown in FIG. 1, particularly illustrating the arc indicator with the arc indicator showing that the sprinkler has been adjusted to full circle operation to water a circle covering 360°.

Sprinkler 2 of this invention also includes a novel arc indicator 180 for visually indicating to the user both the extent of the arc of rotation as well as the absolute direction of the arc segment being watered. This arc indicator 180, positioned on top of drive housing 14 immediately beneath rotatable nozzle assembly 8, will now be described. The appearance of arc indicator 180 to a user observing sprinkler 2 is best illustrated in FIGS. 20, 21 and 27.

Turning to the structure of arc indicator 180, the previously described arc adjustment member 132 shown in FIG. 8 has a central hub 134 that is located above a circular opening 182 in partition 176 in drive housing 14 so as to engage stop assembly 112 carried within drive housing 14, a portion of stop assembly 112 extending upwardly through opening 182 to engage with hub 134 of arc adjustment member 132. Arc adjustment member 132 also includes a cylindrical wall 184 that is stepped or inset relative to a cylindrical rim 186 forming the upper portion of arc adjustment member 132. Cylindrical wall 184 and cylindrical rim 186 are located immediately above drive housing 14 when arc adjustment member 132 is secured to adjustable stop assembly 112. The internal ring gear 140 that is engaged by arc setting shaft 128 is located on an inner diameter of cylindrical rim 186 of arc adjustment member 132. Cylindrical wall 184 beneath rim 186 has a slightly smaller diameter than rim 186 to provide a surface against which an indicator band 188 can be gradually uncovered.

Figure 22:
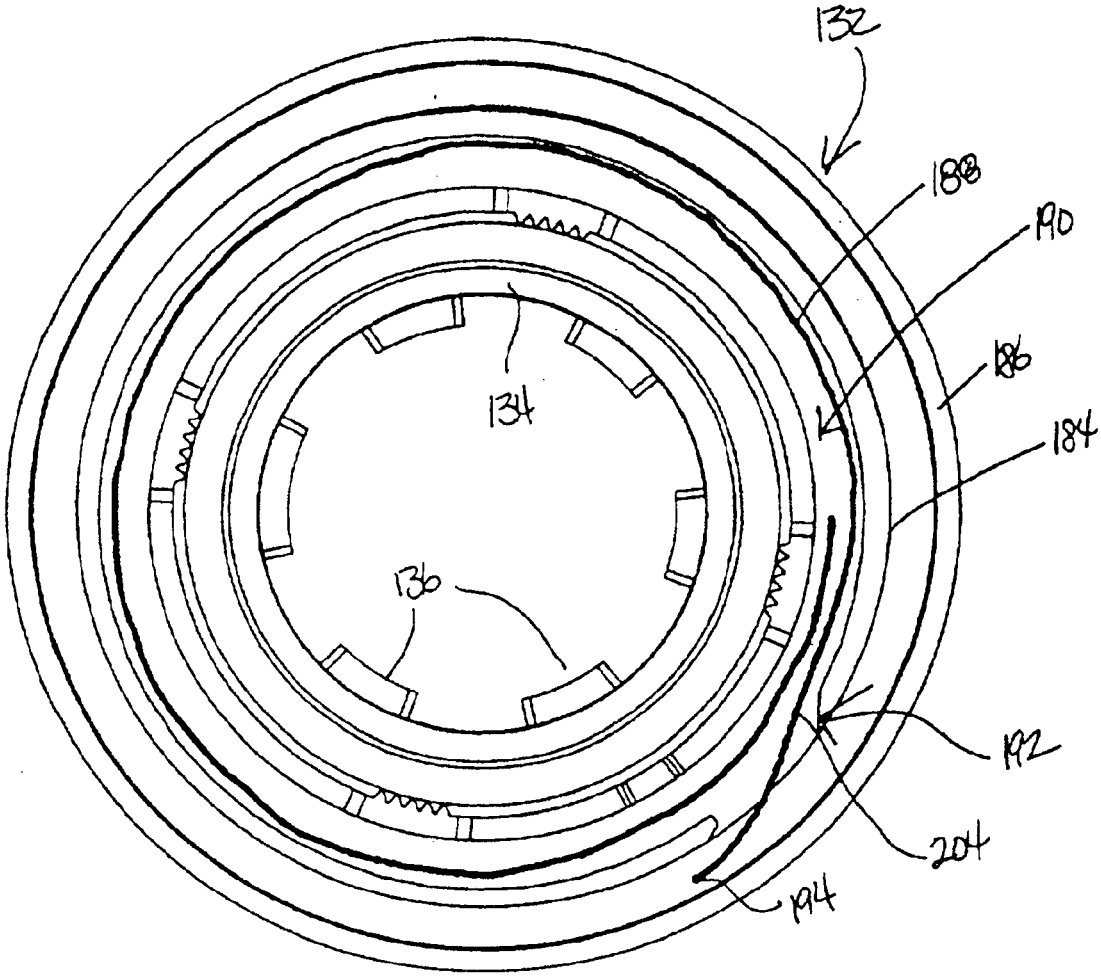
FIG. 22 is a bottom plan view of a portion of the arc indicator shown in FIG. 20, particularly illustrating the insertion of the indicator band into the arc adjustment member with the arc adjustment member being set to provide a minimum arc.
Figure 23:
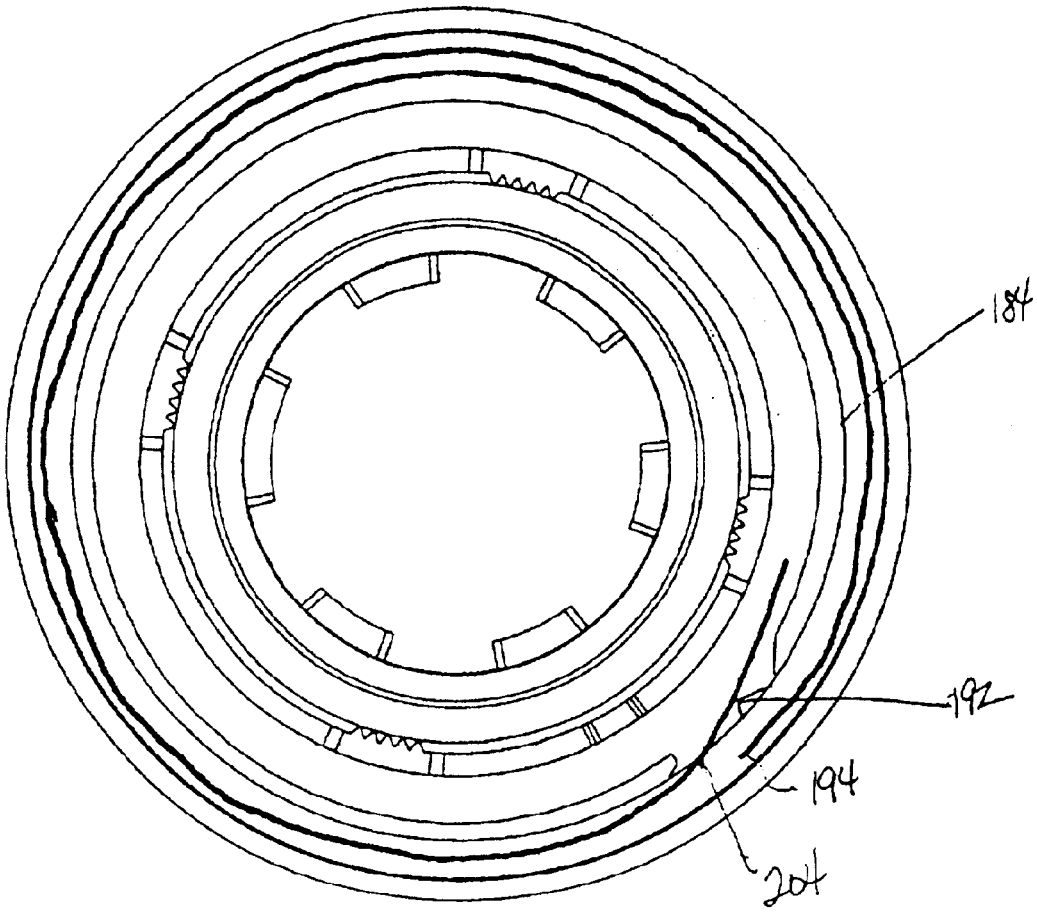
FIG. 23 is a bottom plan view, similar to FIG. 22, of a portion of the arc indicator shown in FIG. 20, particularly illustrating the insertion of the indicator band into the arc adjustment member with the arc adjustment member being set to provide a maximum arc.

Looking at the bottom of arc adjustment member 132 as shown in FIGS. 22 and 23, an interior annular channel 190 is provided adjacent the inner diameter of cylindrical wall 184. A slot 192 is provided in the peripheral cylindrical wall 184 exposing this channel 190. A flexible indicator band 188 can be placed or wound into channel 190 with one end 194 of indicator band 188 extending outwardly through slot 192 in the peripheral cylindrical wall 184 to be exposed outside of cylindrical wall 184. This protruding end 194 of indicator band 188 has a downwardly extending locking tab (not shown).

An outer transparent window 198 covers arc adjustment member 132 including cylindrical rim 186 and peripheral cylindrical wall 184. This window 198 has a notch 200 in an inwardly protruding lower shoulder 202. The locking tab on indicator band 188 is inserted into notch 200 to anchor indicator band 188 in place. Thus, when these parts are assembled, the exposed end 194 of indicator band 188 is visible through transparent window 198 against the background surface provided by peripheral cylindrical wall 184 of arc adjustment member 132.

To more easily view indicator band 188, indicator band 188 and peripheral cylindrical wall 184 of arc adjustment member 132 are provided in contrasting colors. Preferably, arc adjustment member 132 and its peripheral cylindrical wall 184 are molded out of a black plastic, while indicator band 188 can be formed from a bendable, relatively stiff plastic in a bright color other than black, such as white, red, blue, etc. Looking at FIG. 29, indicator band 188 is shown as a dark ring immediately below nozzle assembly 8 on top of drive housing 4.

As just indicated, arc indicator 180 described above is located on top of the non-rotatable drive housing 14 of riser 4 immediately below rotatable nozzle assembly 8. Like drive housing 14, arc indicator 180 does not rotate with nozzle assembly 8 but remains stationary relative to nozzle assembly 8 during normal operation of sprinkler 2. When the user adjusts or changes the arc of rotation of sprinkler 2, arc adjustment member 132 rotates relative to transparent window 198 and indicator band 188. When the arc is being increased, the rotation of arc adjustment member 132 causes indicator band 188 to be progressively uncovered such that more and more of indicator band 188 shows outside on top of peripheral cylindrical wall 184 of arc adjustment member 132. Indicator band 188 itself remains stationary due to its tabbed locking engagement with notch 200 in stationary outer window 198. Conversely, if the arc of rotation is being decreased, indicator band 188 is progressively covered as arc adjustment member 132 moves or rotates in the opposite direction.

The amount which indicator band 188 shows or is visible represents the amount of arc that has been selected by the user. For example, if the arc of rotation is set to a quarter circle or 90°, indicator band 188 will be visible around a quarter or 90° of peripheral cylindrical wall 184. If the user increases the arc to water a half circle or 180°, an additional 90° of indicator band 188 will be uncovered as arc adjustment member 132 is turned so that now indicator band 188 will be visible around a half circle or 180° of peripheral cylindrical wall 184. The visible portion of indicator band 188 thus visually indicates to the user what the selected arc of rotation is. Thus, the user can simply glance at indicator band 188 and tell at an instant what the arc of rotation is by noting how much of indicator band 188 is visible.

Indicator band 188 can be progressively uncovered from a minimum arc of rotation provided by rotary drive 12, which is approximately 30°, as shown in FIG. 12. Note in FIG. 22 that approximately 30° of indicator band 188 is uncovered representing the smallest arc of rotation that can be set for sprinkler 2. In the maximum arc provided by rotary drive 12, namely full circle or 360° operation, indicator band 188 is visible around the entire circumference of arc adjustment member 132. See FIG. 23 which shows that a full 360° uncovering of indicator band 188 has occurred.

In addition, arc indicator 180, including indicator band 188, is entirely positioned on the non-rotary drive housing of riser 4 to itself be non-rotary during operation of sprinkler 2. No portion of arc indicator 180 is carried on rotatable nozzle assembly 8. Thus, arc indicator 180 at all times remains stationary relative to drive housing 14 and to rotary drive 12 carried in riser 4. Part of that rotary drive, as we have seen, is represented by the two arc limit stops, namely fixed arc limit stop 98 and adjustable arc limit stop 100.

This allows the visible ends of indicator band 188 to directly represent the ends of the arc of rotation such that indicator band 188 points in an absolute or non-relative manner at the arc segment of ground being watered. For example, the protruding end 194 of indicator band 188 that is always present outside peripheral cylindrical wall 184 of arc adjustment member 132 can represent the fixed side of the arc. The other visible end 204 of indicator band 188, i.e. the spot on indicator band 188 where the rest of indicator band 188 becomes covered by slot 192 in peripheral cylindrical wall 184, then represents the other or movable side of the arc. As the arc is adjusted upwardly and the movable side of the arc moves away from the fixed side, the visible length of indicator band 188 will grow, but its two visible ends 194 and 204 still represent where the arc of rotation begins and ends.

When indicator band 188 is correlated with the direction in which nozzle body 35 points as is now possible, each end of indicator band 188 can be aligned with nozzle body 35 at the moment of drive reversal. Thus, as nozzle assembly 8 rotates towards its minimum arc, nozzle body 35 will overlie the fixed visible end 194 of indicator band 188 at the moment in time when rotary drive 12 reverses. Then, as nozzle body 35 approaches the maximum arc that has been selected, nozzle body 35 will again overlie the movable visible end 204 of indicator band 188 at the moment in time when rotary drive 12 again reverses to begin moving back.

As a result, the user is informed exactly what arc of ground will be watered by looking at riser 4 when it is popped up since the orientation of the visible portion of indicator band 188 on riser 4 will indicate the absolute direction in which the watered arc of ground will be oriented. For example, if one were looking down at riser 4, if indicator band 188 extends for 90° and is located in the upper right quadrant extending from North to East, then the arc of ground being watered will cover 90° and will be directed to the upper right Northeast quadrant. Knowing that the orientation of indicator band 188 absolutely indicates where the arc being watered will be oriented on the ground helps the user install and properly position sprinkler 2 by adjusting riser 4 within sprinkler body 6, or by adjusting sprinkler body 6 on water fittings connecting to sprinkler body 6, until indicator band 188 points to and covers the arc segment where one wants the water to go.

In FIG. 20, arc indicator 180 indicates a sprinkler 2 that has been set for 270°, with the fixed visible end 194 of indicator band 188 being shown on the front left side of sprinkler 2 and with the movable visible end 204 of indicator band 188 being shown on the front right side of sprinkler 2 in FIG. 20. In FIG. 20, the visible portion of indicator band begins at 194 and extends around the back of sprinkler 2 (where it cannot be seen in FIG. 20) until terminating at 204. The 270° between the ends 194 and 204 means the sprinkler is set to water an arc of 270°. The orientation of the visible portion of indicator band 188 on drive housing 4 shows where that 270. pattern will go, namely in the 270° arc segment mostly facing away from the viewer of FIG. 20. The 90° gap between the visible ends 194 and 204 of indicator band 188, which gap is labeled as x in FIG. 20 and which most directly faces the viewer of FIG. 20, is that portion of the circumference of the sprinkler in which indicator band 188 has not been uncovered and is not visible. No water will be projected in this 90° gap.

If the user adjusts the sprinkler 2 shown in FIG. 20 to achieve full circle or 360° operation, then indicator band 188 will be additionally progressively uncovered with movable visible end 204 of indicator band 188 moving towards fixed visible end 194 (as shown by the arrow C in FIG. 20) to fill in the 90° gap x in FIG. 21. When full circle operation has been set, visible ends 194 and 204 will overlie one another. In this condition, depicted in FIG. 21, indicator band 188 will be visible around the entire circumference of sprinkler 2 to indicate full circle operation.

Arc indicator 180 of this invention has many advantages over prior art indicators. No prior art indicator shows both the amount of the arc of rotation as well as absolutely indicating the arc segment of ground that will be covered by sprinkler 2 in a manner visible to someone observing the exterior of sprinkler 2 when riser 4 is popped up. The advantages of this are apparent.

In addition, no arc indicator known in sprinklers uses a band 188 whose length is related to the amount of the arc being watered. This band 188 whose visible extent can be progressively increased or decreased and whose visible extent is correlated to the arc of rotation of sprinkler 2 drive permits the user to read what the selected arc is at a glance, without having to read a pointer against a scale. Again, the advantages of this are also apparent.

While use of a band type indicator is preferred, the advantages of placing arc indicator 180 entirely on the non-rotary drive housing 14 so that it can simultaneously indicate both the amount of the arc of rotation as well absolutely indicate the direction of the arc segment of ground being watered are useful even if a more traditional pointer and scale type indicator were used in place of an indicator band 188. For example, in such an indicator, peripheral cylindrical wall 184 of arc adjustment member 132 could be provided with a pointer that could be read against a scale inscribed on the transparent window. Such a scale would still indicate the amount of the arc of rotation. In addition, the location of the scale and pointer on the side of riser 4 would still indicate where the arc being watered will point, i.e. the 0 mark on the scale indicating the fixed side of the arc while the position of the movable pointer would indicate the movable side of the arc.

Side Mounted Arc Adjustment Member

Figure 32:
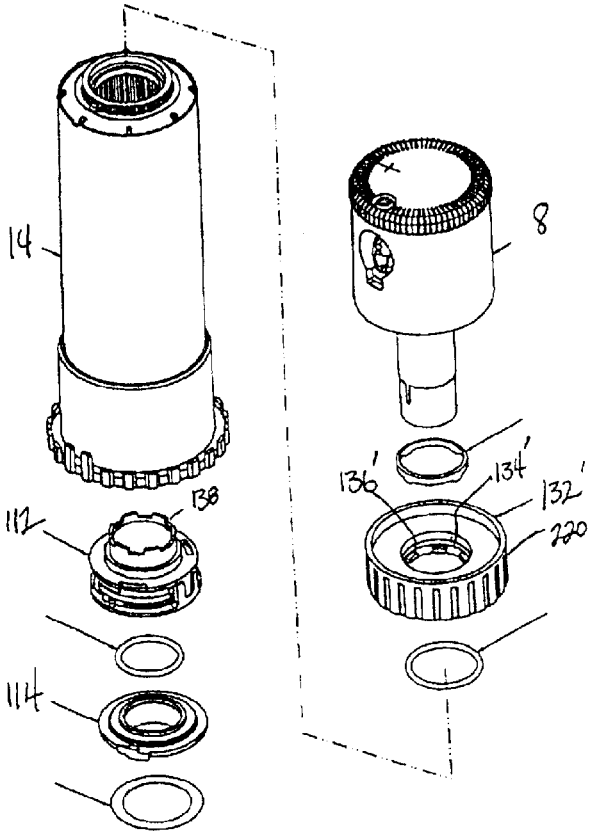
FIG. 32 is an exploded perspective view of some portions of the riser of the sprinkler shown in FIG. 32, particularly illustrating the arc adjustment member beneath the nozzle assembly on the right side of the drawing and the adjustable stop assembly and trip plate on the left side of the drawing.
Figure 31:
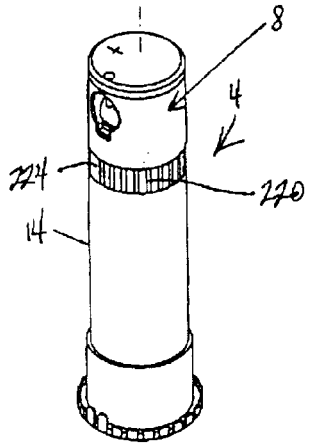
FIG. 31 is a perspective view of the sprinkler riser of the sprinkler shown in FIG. 1, particularly illustrating a second embodiment of the arc adjustment structure used to adjust the arc of rotation provided by the rotary drive.

Referring now to FIGS. 31 and 32, an alternate arc adjustment structure is depicted which adjusts from the side of sprinkler 2 rather than from the top of sprinkler 2.

In this system, an arc adjustment member 132' is provided which sits on top of drive housing 14 in the space previously occupied by indicator 180. Arc adjustment member 132' still has a central hub 134' and inwardly extending teeth 136' that mate with notches 138 in adjustable stop assembly. However, arc adjustment member 132' is now enlarged in size so that it's cylindrical outer wall 220, which is ribbed to allow the user to more easily grip arc adjustment member 132', forms part of the exterior of sprinkler riser 4 and is of the same general diameter as riser 4. In the prior arc adjusting structure, transparent window 198 of indicator 180 was on the exterior of sprinkler riser 4, but now this window 198 and the rest of indicator 180 is gone. In addition, arc setting shaft 128, spring 129, and gear 130 and the ring gear 140 on the arc adjustment member are omitted.

With arc adjustment member 132' shown in FIGS. 31 and 32, one simply grips the outer cylindrical wall 220 of arc adjustment member 132' and directly rotates member 132' in one direction of the other to adjust the arc. A pointer on a non-ribbed portion 224 of wall 220 can be correlated with the movable side of the arc, namely with the movable arc limit stop 100, to indicate or represent where the movable side of the arc. This pointer could be read against a scale placed on drive housing 14 beneath arc adjustment member 132' where the 0 point of the scale would be correlated with the fixed side of the arc as described above. Thus, because arc adjustment member 132' is still carried on the non-rotatable drive housing 14 and does not rotate with nozzle assembly 8, this pointer/scale arrangement, when properly correlated to the direction the nozzle points when the arc limit stops are encountered, will still indicate both the amount of the arc of rotation as well as the absolute direction in which the watered arc segment will extend.

Use of arc adjustment member 132' on the side of sprinkler 2 is simple and easy to rotate and involves fewer parts than what is needed for arc adjustment member 132, namely arc setting shaft 128 and its associated parts can be deleted. However, a vandal can change the arc setting without needing a tool to access the arc adjustment member 132', which can be a disadvantage. In addition, not being able to reach and rotate arc adjustment member 132' from above means that riser 4 must be popped up out of sprinkler body 6 to get access to arc adjustment member 132', which is not true for arc adjustment member 132. Accordingly, a particular user might prefer one type of arc adjustment system over the other depending upon which characteristics of each are more or less desirable to the user.

The Indicia on the Cover

Figure 33:
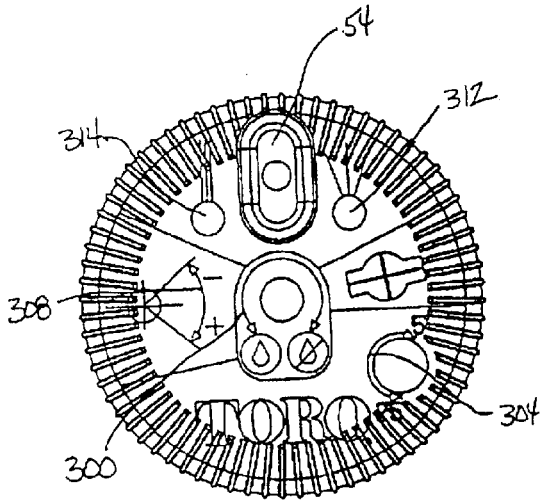
FIG. 33 is a top plan view of the rubber cover for the sprinkler riser of the sprinkler shown in FIG. 1, particularly illustrating various indicia which may be laser etched thereon.

Referring now to FIG. 33, cover 22 can be provided with various indicia or markings to help the user make the various adjustments which are permitted for sprinkler 2.

A first marking 300 partially surrounds the hole in cover 22 through which top end 29 of shaft 32 of flow shut off valve 28 will protrude. Marking 300 is provided with arrows that point to water on/water off symbols to indicate the direction to turn shaft 32 to open or close, respectively, flow shut off valve 28.

A second marking 304 partially surrounds the hole in cover 22 through which the upper end of trajectory setting shaft 48 will protrude. Marking 304 is provided with arrows that point to the marked minimum and maximum trajectory angles, namely a minimum trajectory angle of 5° and a maximum trajectory angle of 25°. This indicates the direction to turn trajectory setting shaft 48 to increase or decrease the trajectory and also indicates what the minimum and maximum trajectory angles are, namely 5° and 25°.

A third marking 308 is adjacent the slit in cover 22 through which access is had to the top of arc setting shaft 128. Marking 308 is provided with arrows adjacent plus/minus symbols to indicate the direction to turn arc setting shaft 128 to increase or decrease, respectively, the arc of rotation. As noted earlier herein, the amount of the arc of rotation and the absolute direction of the arc segment being watered is indicated by indicator 180 on top of drive housing 14.

Additional markings 312 and 314 are located adjacent screw head receiving portion 54 in cover 22. Marking 312 represents a diffuse spray where the water stream exiting nozzle 10 is relatively more broken up. Marking 314 represents a tighter, less diffuse spray where the water stream exiting nozzle 10 is relatively less broken up. Rotating the head of radius adjustment screw 42, which screw head is carried on top of screw head receiving portion 54, towards marking 312 will lower radius adjustment screw 42 relative to nozzle 10 to cause a more diffuse spray. Conversely, rotating the head of radius adjustment screw 42, which screw head is carried on top of screw head receiving portion 54, towards marking 314 will raise radius adjustment screw 42 relative to nozzle 10 to cause a more diffuse spray.

The Applicants have found that such markings 300, 304, 308, 312 and 314 can be provided by laser etching such markings on rubber cover 22 using a generally conventional laser etching process, which process has not previously been used to etch markings on sprinklers or parts thereof. Use of a laser etching process for these sprinkler markings has been found desirable as it provides a very vibrant and easily seen marking.

Sprinkler 2 can obviously be built with less than all the adjustments described herein. For example, a version of sprinkler 2 could be built in which the trajectory adjusting structure is omitted such that nozzle 10 throws a water stream at a fixed angle of trajectory. Alternatively, flow shut off valve 28 could be omitted. If this occurs, the relevant markings would be omitted from cover 22 as well.

The Rebar Attachment Collar

Sprinklers 2 of the type disclosed herein are sometimes used in installations where the sprinklers are not buried in the ground, but are used above ground. In this case, the standpipe to which sprinkler body 6 is secured will hold sprinkler 2 up above the ground, but sprinkler 2 will still lean to one side of the other. Thus, stakes or posts, commonly formed out of rebar, are pushed into the ground adjacent such an above ground mounted sprinkler 2. Sprinkler 2 is tied to this rebar support stake to prevent it from leaning over too much and to keep it generally upright. The need to tie sprinkler 2 to such a rebar is an obvious disadvantage of prior art sprinklers.

Figure 34:
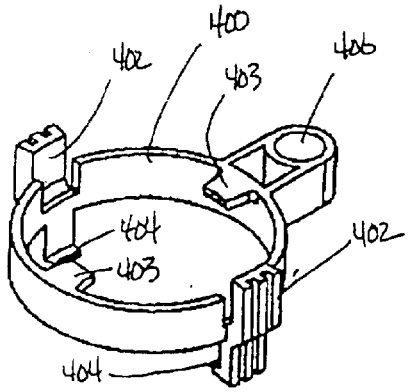
FIG. 34 is a perspective view of a rebar attachment collar that may be secured to the sprinkler shown in FIG. 1 to allow a rebar support stake or the like to support the sprinkler against leaning when the sprinkler is used in an above ground installation.

FIG. 34 illustrates a collar 400 that may be removably attached to sprinkler 2. Collar 400 is sized to have a diameter that closely fits around cap 5 on sprinkler 2. Collar 400 has resilient latching fingers 402 that carry latching tabs 404 that normally engage beneath the lower rim of cap 5. In addition, collar 400 has flat, upper tabs 403 that rest on top of cap 5 when latching tabs 404 are engaged beneath the lower rim of cap 5.

To install collar 400, collar 400 is simply pushed down onto cap 5 with fingers 402 deflecting outwardly until latching tab 404 on each finger 402 passes beneath the lower rim of cap 5. At that point, the resilient nature of fingers 402 causes latching tabs 404 to snap underneath the lower rim of cap 5 to hold collar 400 in place on cap 5. The user can manually remove collar 400 if so desired simply by pressing inwardly on the tops of latching fingers 402, thus flexing fingers 402 enough to cause latching tabs 404 to be moved out sufficiently to clear cap 5. Collar 400 can then be pulled upwardly off cap 5.

Collar 400 includes a vertically extending opening 406 that is spaced to one side of collar 400. Opening 406 is sized to allow a rebar support stake or the like to pass therethrough. Thus, if collar 400 is secured to the cap 5 of a sprinkler 2 that is to be used in an above ground installation, a rebar support stake or the like can easily pass through opening 406 on collar 400 to prevent sprinkler 2 from leaning too much, without having to manually tie sprinkler 2 to such a support stake. Collar 400 would be used principally on sprinklers 2 placed into above ground installations.

Description of Preferred Embodiments

This Detailed Description sets forth various preferred embodiments for various aspects of a rotary sprinkler 2 of the type shown herein. However, embodiments other than those illustrated herein fall within this invention. For example, the arc indicators illustrated herein can be used in sprinklers 2 having reversible drives of other types, such as reversible ball or shiftable stator drives. Thus, various modifications of this invention will be apparent to those skilled in the art. Accordingly, the invention is to be limited only by the appended claims.

We claim:

1. A rotary sprinkler, which comprises:

(a) a drive housing that encloses an oscillating drive having at least one movable arc limit stop that can be selectively moved by a user to adjust an angular extent of an arc segment;

(b) a rotary nozzle assembly carried on the drive housing and coupled to the drive located within the drive housing, wherein the rotary nozzle assembly is oscillated by the drive back and forth relative to the drive housing to water the adjustable arc segment; and (c) an arc indicator carried on an exterior of the drive housing and operatively coupled to the movable arc limit stop within the drive housing to visually indicate to a user both the angular extent and absolute direction of the arc segment.

2. The rotary sprinkler of claim 1, wherein the drive housing and the drive which the drive housing encloses, the rotary nozzle assembly, and the arc indicator are all part of a pop-up sprinkler riser carried within a sprinkler body.

3. The rotary sprinkler of claim 1, wherein the arc indicator comprises an indicator band having a portion which is visible to the user with the visible portion of the indicator band having a length which is representative of the angular extent of the arc segment.

4. The rotary sprinkler of claim 3, wherein the ends of the visible portion of the indicator band are continuously aligned with spaced side boundaries of the arc segment to absolutely indicate the direction of the arc segment relative to a fixed reference regardless of the nozzle assembly's instantaneous position relative to the drive housing.

5. A rotary sprinkler, which comprises:

(a) an oscillating drive for watering an arc segment on the ground, wherein the arc segment has an angular extent between spaced side boundaries of the arc segment which angular extent is determined by an arc of rotation provided by the oscillating drive, wherein the arc of rotation provided by the oscillating drive is determined by an angular distance between two arc limit stops, and wherein the two arc limit stops are angularly adjustable relative to one another to adjust the angular distance between the two arc limits and thereby to adjust the arc of rotation provided by the oscillating drive to adjust the angular extent of the arc segment;

(b) a rotary nozzle assembly coupled to the drive such that the rotary nozzle assembly is oscillated by the drive back and forth to water the adjustable arc segment; and (c) an arc indicator having two sides with each side of the arc indicator remaining aligned with one of the side boundaries of the arc segment regardless of the rotary nozzle assembly's instantaneous position during oscillation of the rotary nozzle assembly to absolutely indicate to the user the arc segment's direction, and wherein the angular distance between the sides of the arc indicator corresponds to the angular distance between the two arc limit stops to represent the angular extent of the arc segment.

6. The rotary sprinkler of claim 5, wherein the two arc limit stops comprise one fixed arc limit stop and one movable arc limit stop, wherein the movable arc limit stop is angularly adjustable towards and away from the fixed arc limit stop to provide the relative angular adjustment between the two arc limit stops.

7. The rotary sprinkler of claim 6, wherein the two sides of the arc indicator comprise a fixed side aligned with the fixed arc limit stop and a movable side aligned with the movable arc limit stop.

8. The rotary sprinkler of claim 7, wherein the movable side of the arc indicator is operatively coupled to the movable arc limit stop to move in concert with the movable arc limit stop.

9. The rotary sprinkler of claim 7, wherein the arc indicator comprises a continuous indicator band having visible ends, and wherein the fixed and movable sides of the arc indicator comprise the visible ends of the indicator band.

10. The rotary sprinkler of claim 9, wherein the indicator band has a contrasting color relative to adjacent portions of the sprinkler to allow the indicator band to be more easily seen.

11. The rotary sprinkler of claim 7, wherein the arc indicator comprises:

(a) a scale having a zero mark and spaced degree markings; and (b) a movable pointer that can be read against the scale; and wherein the fixed and movable sides of the arc indicator comprise the zero mark of the scale and the movable pointer, respectively.

12. A rotary sprinkler, which comprises:

(a) a nozzle assembly for ejecting water from the sprinkler;

(b) an oscillating drive operatively coupled to the sprinkler for oscillating the nozzle assembly back and forth through an arc of rotation to water an arc segment with the arc segment having an angular extent determined by the arc of rotation through which the nozzle assembly oscillates, wherein the oscillating drive is adjustable to vary the angular extent of the arc segment; and (c) an arc indicator comprising an indicator band having a visible length which varies in accordance with the angular extent of the arc segment such that the indicator band appears longer as the angular extent of the arc segment increases and the indicator band appears shorter as the angular extent of the arc segment decreases whereby the visible length of the indicator band visually represents the angular extent of the arc segment.

13. The rotary sprinkler of claim 12, wherein the indicator band has a contrasting color with respect to adjacent portions of the sprinkler to allow the indicator band to be more easily seen.

14. The rotary sprinkler of claim 12, wherein the sprinkler includes a housing that is non-rotatable during oscillation of the nozzle assembly, and wherein the indicator band is carried on the housing such that it does not move with the nozzle assembly during oscillation of the nozzle assembly but remains stationary relative to the nozzle assembly.

15. The rotary sprinkler of claim 14, wherein the visible length of the indicator band is oriented on the housing to point where the arc segment being watered by the nozzle assembly is located on the ground.

16. The rotary sprinkler of claim 12, wherein the indicator band circumferentially extends around the sprinkler over a circumferential distance encompassing a maximum value provided for the arc segment, and wherein the visible length of the indicator band is provided by an adjustment member that is movable relative to the indicator band to progressively uncover the indicator band from a first end thereof towards a second end thereof as the angular extent of the arc segment progressively increases, whereby the visible length of the indicator band is formed by the uncovered portion of the indicator band.

17. The rotary sprinkler of claim 16, wherein the adjustment member includes an interior annular channel that is accessible through a slot in the adjustment member with the channel being configured to substantially cover and hide that portion of the indicator band received inside the channel, wherein the first end of the indicator band has a fixed engagement with the sprinkler outside of the annular channel with the indicator band extending circumferentially away from the first end of the indicator band to pass through the slot and to be wound around and received inside the annular channel, and wherein the indicator band is uncovered by rotation of the adjustment member relative to the indicator band such that more and more of the indicator band is located outside of the channel to be visible while less and less of the indicator band is hidden inside the channel as the arc segment increases, and vise versa.

18. The rotary sprinkler of claim 17, wherein the oscillating drive is adjustable by angularly adjusting two arc limit stops relative to one another by angularly moving at least one of the arc limit stops towards and away from the other arc limit stop, and wherein the adjustment member carrying the interior annular channel is part of an arc adjustment member that is operatively coupled to the at least one movable stop such that the indicator band is progressively covered and uncovered by the adjustment member as the at least one movable stop is moved towards and away from the other arc limit stop.

19. The rotary sprinkler of claim 16, further including a transparent window overlying and covering the indicator band the adjustment member.

20. The rotary sprinkler of claim 12, wherein the indicator band is carried on an exterior portion of the sprinkler.

21. The rotary sprinkler of claim 19, wherein the indicator band is carried on an exterior portion of the sprinkler that is visible to an observer during oscillation of the nozzle assembly.

22. The rotary sprinkler of claim 19, wherein the indicator band is carried around a cylindrical housing of the sprinkler.

23. The rotary sprinkler of claim 12, wherein the visible length of the indicator band at a maximum length thereof extends 360°.

24. The rotary sprinkler of claim 12, wherein the visible length of the indicator band extends circumferentially around a cylindrical housing of the sprinkler.

25. The rotary sprinkler of claim 24, wherein the cylindrical housing around which the visible length of the indicator band circumferentially extends is a housing that remains rotationally stationary during oscillation of the nozzle assembly.

26. An arc indicator for a rotary sprinkler having an oscillating drive which drive is adjustable to vary the angular extent of an arc segment being watered by the sprinkler, which comprises:

(a) an indicator band having a visible portion that has a length which is related to the angular extent of the arc segment; and (b) an adjustment member that moves relatively to the indicator band and in concert with an increase and decrease in the angular extent of the arc segment to increase and decrease the length of the visible portion of the indicator band in concert with an increase and decrease in the angular extent of the arc segment.

27. An arc indicator for a rotary sprinkler having an oscillating drive which drive is adjustable to vary the angular extent of an arc segment being watered by the sprinkler, which comprises:

an indicator band having a visible angular length that is substantially equal to and varies with the angular extent of the arc segment as the angular extent of the arc segment is adjusted.

28. A rotary sprinkler which has adjustable part circle operation, which comprises:

(a) an oscillating, reversible drive for providing oscillating rotation during part circle operation, wherein the drive includes two angularly spaced arc limit stops that provide torque to a shiftable toggle member to toggle the toggle member to reverse the drive;

(b) a rotary nozzle assembly coupled to the drive for rotation therewith; and (c) a stop assembly which is rotationally adjustable relative to the toggle member, wherein the stop assembly carries one arc limit stop and the toggle member carries the other arc limit stop such that rotational adjustment of the stop assembly relative to the toggle member moves the one arc limit stop angularly towards and away from the other arc limit stop to provide for adjustable part circle operation, the one arc limit stop normally being disengaged from the toggle member to allow for rotational movement of the stop assembly to provide angular adjustment of the one arc limit stop relative to the other arc limit stop but momentarily engaging the toggle member when the one arc limit stop is engaged by a trip tab to reverse the drive.

29. The rotary sprinkler of claim 28, wherein the one arc limit stop is momentarily engaged to the toggle member by a pivotal pawl.

30. The rotary sprinkler of claim 29, wherein the toggle member includes a serrated section, and wherein the pivotal pawl pivots to engage the serrated section to momentarily engage the one arc limit stop to the toggle member.

31. The rotary sprinkler of claim 30, further including:

(a) a spring for biasing the pawl in a direction in which the pawl engages the serrated section of the toggle member; and (b) a cam acting on the pawl to normally prevent the bias exerted on the pawl by the spring from pivoting the pawl.

32. The rotary sprinkler of claim 31, wherein the cam releases the pawl when the pawl is engaged by the trip tab to allow the bias exerted on the pawl by the spring to pivot the pawl.

33. The rotary sprinkler of claim 32, wherein the cam reengages the pawl after drive reversal to pivot the pawl in a reverse direction to disengage the pawl from the serrated section of the toggle member.

34. The rotary sprinkler of claim 29, wherein the toggle member is cylindrical with a serrated section being located on an interior diameter of the cylindrical toggle member, and wherein the stop assembly has a portion which carries the pivotal pawl with the pawl carrying portion of the stop assembly being concentrically received inside the cylindrical toggle member such that the pawl pivots radially outwardly relative to the stop assembly to engage the serrated ring.

35. The rotary sprinkler of claim 34, wherein the pawl carrying portion of the stop assembly comprises a stop plate which stop plate also carries the one arc limit stop.

36. The rotary sprinkler of claim 35, further including a torsion spring for normally biasing the pawl into an engaged position in which the pawl engages the serrated section of the toggle member, the pawl having a cam surface which cooperates with a cam on an adjacent portion of the stop assembly such that the cam normally bears against the cam surface on the pawl to pivot the pawl against the bias of the torsion spring into a disengaged position in which the pawl is disengaged from the serrated section of the toggle member.

37. The rotary sprinkler of claim 36, wherein engagement of the one arc limit stop by the trip tab moves the cam surface on the pawl out of engagement with the cam to allow the torsion spring to pivot the pawl from the pawl's disengaged position into the pawl's engaged position.

38. The rotary sprinkler of claim 36, wherein the cam is carried on a ring overlying the stop plate with the stop plate being angularly shiftable relative to the ring by an amount sufficient to disengage the cam surface on the pawl from the cam on the ring.

39. The rotary sprinkler of claim 34, wherein the serrated section comprises a serrated ring on an interior diameter of the cylindrical toggle member.

40. A rotary sprinkler which is adjustable between part circle and full circle operation, which comprises:

(a) an oscillating, reversible drive for providing oscillating rotation during part circle operation, wherein the drive includes two angularly spaced arc limit stops that cooperate with a trip mechanism for shifting the drive to reverse the drive;

(b) a rotary nozzle assembly coupled to the drive for rotation therewith;

(c) an angularly adjustable stop assembly carrying one arc limit stop to allow the one arc limit stop to be angularly moved towards and away from the other arc limit stop to provide for adjustable part circle operation; and (d) wherein the one arc limit stop automatically moves vertically whenever the one arc limit stop is spaced 360° from the other arc limit stop to move the one arc limit stop vertically out of engagement with the trip mechanism to thereafter provide full circle operation of the drive.

41. The rotary sprinkler of claim 40, further including a spring for vertically biasing the one arc limit in a first vertical direction to bias the one arc limit stop into a position in which it is vertically out of engagement with the trip mechanism, and wherein a tab is normally provided on an adjacent portion of the sprinkler for pushing the one arc limit stop in a second direction opposite to the first direction into a position where the one arc limit stop will normally engage the trip mechanism to provide part circle operation.

42. The rotary sprinkler of claim 41, wherein the one arc limit stop is carried on a stop plate, wherein the spring biases the stop plate in the first direction, and wherein the tab pushes on the stop plate in the second direction.

43. The rotary sprinkler of claim 42, wherein the tab pushes on the stop plate by pushing on a full circle ring interposed between the tab and the stop plate.

44. The rotary sprinkler of claim 43, wherein the full circle ring includes a cut-out or notch, and wherein the tab on the adjacent portion of the sprinkler enters into the cut-out or notch whenever the one arc limit stop is spaced 360° from the other arc limit stop to allow the spring to move the stop plate and the full circle ring vertically sufficiently far to move the one arc limit stop on the stop plate vertically out of engagement with the trip mechanism.

45. The rotary sprinkler of claim 44, wherein the tab has a slanted cam surface such that when the one arc limit stop is adjusted to be less than 360° from the other arc limit the slanted cam surface will force the tab out of the cut-outs or notch to allow the tab to ride up onto the full circle ring to again push the full circle ring and the stop plate in the second direction against the bias of the spring.

46. The rotary sprinkler of claim 44, further including a plurality of spaced tabs on the adjacent portion of the spring received in a plurality of spaced cut-outs or notches on the full circle ring whenever the one arc limit stop is spaced 360° from the other arc limit stop.

47. The rotary sprinkler of claim 41, wherein the spring is a torsion spring.

48. The rotary sprinkler of claim 41, wherein each tab provided on the adjacent portion of the sprinkler enters into a cut-out or notch provided in a portion of the adjustable stop assembly to allow the portion of the stop assembly having the cut-outs or notches to move vertically in the first direction under the influence of the spring, such motion in the first direction of the portion of the stop assembly allowing the one arc limit stop to also move vertically into a position in which the one arc limit stop is vertically out of engagement with the trip mechanism.

49. A rotary sprinkler which has adjustable part circle operation, which comprises:

(a) an oscillating, reversible drive for providing oscillating rotation during part circle operation;

(b) a rotary nozzle assembly coupled to the drive for rotation therewith; and (c) a buckling spring assembly having first and second over-center, bi-stable positions with the buckling spring assembly being in the first bi-stable position when the drive provides rotation to the nozzle assembly in a first direction and with the buckling spring assembly being in the second bi-stable position when the drive provides rotation to the nozzle assembly in a second direction which is opposite to the first direction; and (d) wherein the buckling spring assembly comprises:

(i) a compression spring having opposite ends;

(ii) first and second pivot members that are spaced from one another with the pivot members having pins or dowels that generally face one another, wherein the opposite ends of the compression spring are received on the facing pins or dowels such that the compression spring extends between and is connected to the first and second pivot members; and (iii) wherein pivoting motion of the first pivot member relative to the second pivot member causes the compression spring to buckle between the ends of the spring as the buckling spring assembly moves from one bi-stable position towards another bi-stable position with such buckling motion of the compression spring then causing the second pivot member to pivot to reverse the drive.

50. The rotary sprinkler of claim 49, wherein the first and second pivot members are carried on a common base plate.

51. The rotary sprinkler of claim 50, wherein the first and second pivot members pivot on pivot pins that are carried on the base plate with the pivot pins beings spaced apart from one another on the base plate and with the pivot pins being parallel to one another.

52. The rotary sprinkler of claim 51, wherein the pivot pins are perpendicular to the dowels or pins which receive the ends of the compression spring.

53. A rotary sprinkler which has adjustable part circle operation, which comprises:

(a) an oscillating, reversible drive for providing oscillating rotation during part circle operation;

(b) a rotary nozzle assembly coupled to the drive for rotation therewith; and (c) a buckling spring assembly having first and second over-center, bi-stable positions with the buckling spring assembly being in the first bi-stable position when the drive provides rotation to the nozzle assembly in a first direction and with the buckling spring assembly being in the second bi-stable position when the drive provides rotation to the nozzle assembly in a second direction which is opposite to the first direction; and (d) wherein the buckling spring assembly comprises:

(i) a common base plate;

(ii) first and second pivot members pivotally connected to the base plate by first and second pivot pins that extend outwardly from one side of the base plate with the first and second pivot pins being parallel to one another, wherein the first pivot member is pivotally received on the first pivot pin and the second pivot member is pivotally received on the second pivot pin and when the first and second pivot pins are so received they are spaced from one another along the base plate; and (iii) a compression spring extending along the base plate with the compression spring having first and second ends, wherein the first end of the compression spring is attached to the first pivot member and the second end of the compression spring is attached to the second pivot member with an intermediate portion of the compression spring being unsupported such that the compression spring can buckle between its ends in the intermediate portion of the compression spring as the first pivot member is pivoted relative to the second pivot member.

54. The rotary sprinkler of claim 53, wherein the first and second ends of the springs are connected to the first and second pivot members by virtue of each spring end being received around a dowel or pin carried on one of the pivot members.

55. A method of manufacturing rotary gear drives for a rotary sprinkler which drives provide both continuous and intermittent rotation, which comprises:

(a) manufacturing a continuous version of the sprinkler drive which comprises providing:
  (i) a turbine at a lower end of the drive;
  (ii) a gear train including a plurality of speed reducing gear stages stacked above the turbine with the gear stages being located in a gear case, the turbine being operatively coupled to the gear train to rotate the gear train including its speed reducing gear stages when the turbine is rotated at a particular speed by water flowing past the turbine;
  (iii) an output gear located outside of the gear case and operatively connected to the gear train such that the output gear has a slower rotational speed than that of the turbine; and
  (iv) wherein the gear train comprises a plurality of normal gears with regularly shaped teeth to provide continuous rotation of the output gear; and (b) manufacturing an intermittent version of the sprinkler drive which comprises manufacturing the continuous version of the sprinkler drive except that multilated gears are used in place of some of the normal gears in the gear train of the continuous version of the sprinkler drive.

56. A friction clutch for preventing damage to a rotary drive of a rotary sprinkler during periods of forced rotation of a nozzle assembly of the sprinkler, which comprises:

(a) a driving gear on the rotary drive which driving gear is provided with a cylindrical hub having a plurality of vertically extending teeth;

(b) a driven member fixed to the nozzle assembly, the driven member also having a cylindrical hub with a plurality of vertically extending teeth;

(c) wherein the cylindrical hubs on the driving gear and the driven member are concentrically positioned relative to one another with one hub concentrically received inside the other hub such that an annular channel is formed between the hubs, and wherein the vertically extending teeth on the two hubs are located on radially inner and outer sides of the channel, respectively, with the teeth of one hub on one side of the channel being spaced from the teeth of the other hub on the other side of the channel so that the teeth of one hub on one side of the channel do not directly engage the teeth of the other hub on the other side of the channel; and (d) a friction material arranged in the channel between the two hubs to transfer torque from the driving gear to the driven member to rotate the nozzle assembly, the friction material normally transferring torque between the driving gear and the driven member but allowing the driven member to slip relative to the driving gear to prevent damage to the rotary drive when torque above a certain level is imposed on the driven member by forced nozzle rotation.

57. The rotary sprinkler of claim 56, wherein the friction material is an annular ring received in the channel between the hubs.

58. The rotary sprinkler of claim 57, wherein the annular ring is made of an elastomeric material.

59. The rotary sprinkler of claim 58, wherein the ring is selected in conjunction with the spacing between the teeth to provide transfer of all torque below a first force level but to allow slipping at torque above a second force level.

60. The rotary sprinkler of claim 59, wherein the ring is pre-lubricated in a high viscosity lubricating oil such that the pre-lubricated ring in conjunction with the spacing between teeth provides transfer of all torque below the first force level but allows slipping at torque above the second force level.

61. The rotary sprinkler of claim 59, wherein the first force level is approximately 4 inch pounds of force and the second force level is approximately 6 inch pounds of force.

62. The rotary sprinkler of claim 59, wherein the lubricating oil has approximately the following viscosity:

| | CST | SUS |
|---|---|---|
| 100° F. | 54–58 | 234–258 |
| 210° F. | 10–11.5 | 49.7–54.9. |

63. The rotary sprinkler of claim 56, wherein the vertically extending teeth on the two hubs are asymmetrically arranged relative to one another.

64. The rotary sprinkler of claim 63, wherein the teeth on one hub are spaced around the one hub at regular circumferential intervals while the teeth on the other hub are spaced around the other hub at non-constant circumferential intervals.

65. A friction clutch for preventing damage to a rotary drive of a rotary sprinkler during periods of forced rotation of a nozzle assembly of the sprinkler, which comprises:

(a) driving and drive members having annular arrays of clutch teeth that are concentrically arranged relative to one another with one annular array of clutch teeth being concentrically received inside the other annular array of clutch teeth;

(b) an elastomeric O-ring located between the annular arrays of clutch teeth to transfer torque between the annular arrays of clutch teeth to thereby cause the driving member to drive the driven member;

(c) and wherein the clutch teeth in one annular array of teeth are spaced at non-constant circumferential intervals.

66. The rotary sprinkler of claim 65, wherein the clutch teeth in the other annular array of teeth are spaced at constant circumferential intervals.

67. The rotary sprinkler of claim 66, wherein the non-constant circumferential intervals are irregular.

68. A friction clutch for preventing damage to a rotary drive of a rotary sprinkler during periods of forced rotation of a nozzle assembly of the sprinkler, which comprises:

(a) driving and drive members having arrays of clutch teeth that are adjacent to one another with one array of clutch teeth facing the other array of clutch teeth;

(b) an elastomeric O-ring located between the arrays of clutch teeth to transfer torque between the arrays of clutch teeth to thereby cause the driving member to drive the driven member; and (c) wherein the clutch teeth in the arrays of teeth are asymmetrical relative to one another.

69. A friction clutch for preventing damage to a rotary drive of a rotary sprinkler during periods of forced rotation of a nozzle assembly of the sprinkler, which comprises:

(a) driving and drive members having arrays of clutch teeth that are adjacent to one another with one array of clutch teeth facing the other array of clutch teeth;

(b) an elastomeric O-ring located between the arrays of clutch teeth to transfer torque between the arrays of clutch teeth to thereby cause the driving member to drive the driven member; and (c) wherein the O-ring is pre-lubricated in a high viscosity lubricating oil.

70. A nozzle assembly for a rotary sprinkler in which the nozzle assembly ejects a stream of water to one side of the nozzle assembly as the nozzle assembly is rotated by a rotary drive, which comprises:

(a) a nozzle housing;

(b) a nozzle cradle pivotally carried on the nozzle housing for pivoting motion relative to the nozzle cradle about a substantially horizontal pivot axis;

(c) a nozzle carried in the nozzle cradle with the nozzle having an outlet for ejecting a stream of water, wherein the trajectory of the water stream ejected by the nozzle is raised and lowered as the nozzle cradle is pivoted upwardly and downwardly; and (d) a radius adjustment screw carried in the nozzle cradle such that a lower end of the radius adjustment screw can move progressively out of and into the water stream exiting from the nozzle as the radius adjustment screw is screwed up and down on the nozzle cradle, the radius adjustment screw moving with the nozzle cradle as the nozzle cradle is pivoted upwardly and downwardly relative to the nozzle housing such that the radius adjustment screw once adjusted maintains a constant position relative to the nozzle even as the trajectory of the nozzle is adjusted.

71. The rotary sprinkler of claim 70, wherein the nozzle is removable from the nozzle cradle to allow nozzles with differently sized outlets to be installed in the nozzle cradle.

72. The rotary sprinkler of claim 70, wherein the nozzle cradle has a seat which receives a screw or worm on a trajectory setting shaft, rotation of the shaft acting through the screw or worm against the seat to pivot the nozzle cradle upwardly and downwardly depending upon the direction of rotation of the trajectory setting shaft.

73. The rotary sprinkler of claim 72, wherein the trajectory setting shaft extends to an exterior of the nozzle housing so that the trajectory setting shaft can be rotated from exteriorly of the nozzle housing.

74. The rotary sprinkler of claim 72, wherein the nozzle housing includes a top with the trajectory setting shaft being accessible from or through the top such that the trajectory setting shaft can be rotated from above the top of the nozzle housing.

75. The rotary sprinkler of claim 70, wherein the nozzle cradle carries curved tabs with one curved tab extending outwardly from each side of the nozzle cradle, and wherein the curved tabs on the nozzle cradle are captured within curved slots provided in the nozzle housing to pivotally journal the nozzle cradle within the nozzle housing, the tabs sliding up and down in the slots as the nozzle cradle pivots.

76. The rotary sprinkler of claim 70, wherein the radius adjustment screw has an upper head which the user can turn to screw the radius adjustment screw upwardly and downwardly relative to the nozzle cradle, and wherein the upper head of the radius adjustment screw is received in a flexible portion of a top cover of the nozzle housing to allow the upper head of the radius adjustment screw to tilt back or forth relative to the top cover of the nozzle housing.

77. The rotary sprinkler of claim 76, wherein the top cover is a rubber cover that covers a top wall of the nozzle housing.

78. The rotary sprinkler of claim 77, wherein the flexible portion of the top cover comprises a section of the top cover which is separated from a remaining portion of the top cover by a channel and is attached to the remaining portion of the top cover only by a thin membrane which bridges the channel such that the section of the top cover can tilt or flex relative to the remainder of the top cover without distorting of flexing the remaining portion of the top cover.

79. The rotary sprinkler of claim 78, wherein the section of the top cover includes an opening extending therethrough which opening receives a shank of the radius adjustment screw with the shank passing through the opening, and wherein the upper head of the adjustment screw is enlarged relative to the shank of the radius adjustment screw such that the enlarged head of the radius adjustment screw rests on top of the flexible portion of the top cover.

80. A nozzle assembly for a rotary sprinkler in which the nozzle assembly ejects a stream of water to one side of the nozzle assembly as the nozzle assembly is rotated by a rotary drive, which comprises:

(a) a nozzle housing having a top cover;

(b) a nozzle carried in the nozzle housing for ejecting stream of water therefrom, the nozzle being pivotal relative to the nozzle housing to raise and lower the trajectory of the water stream;

(c) a radius adjustment screw that pivots in concert with the nozzle to maintain a fixed relationship to the nozzle after the radius adjustment screw has been adjusted, the radius adjustment screw having a shank and an enlarged head which may be engaged by a tool for adjusting the radius adjustment screw; and (d) wherein the enlarged head of the radius adjustment screw is received on top of a flexible portion of the top cover of the nozzle housing to be accessible from above the nozzle housing with the shank of the radius adjustment screw passing down through an opening in the top cover, wherein the flexible portion of the top cover can flex or tilt relative to a remaining portion of the top cover to accommodate the tilting of the shank of the radius adjustment screw that occurs when the trajectory of the water stream is adjusted by pivoting the nozzle.

81. The rotary sprinkler of claim 80, wherein the flexible portion of the top cover is a portion which is isolated from the remaining portion of the top cover by a channel that completely surrounds the flexible portion of the top cover, the flexible portion of the top cover being connected to the remaining portion of the top cover by a thin, flexible membrane which allows the flexible portion of the top cover to flex relative to the remaining portion of the top cover by deformation of the membrane.

82. The rotary sprinkler of claim 81, wherein the flexible portion of the top cover, the remaining portion of the top cover, and the thin membrane are all integrally formed from an elastomeric material.

83. The rotary sprinkler of claim 81, wherein the thin membrane is at a bottom of the channel.

84. A rotary sprinkler, which comprises:

(a) a drive for providing rotation;

(b) a rotary nozzle assembly coupled to the drive for rotation therewith, the rotary nozzle assembly including a water supply tube for bringing a water flow to the nozzle assembly to allow the water flow to be ejected from the nozzle assembly; and (c) a flow shut off valve having a portion thereof extending into and through at least a portion of the water supply tube, the portion of the flow shut off valve received inside the water supply tube having at least one stream straightening vane located thereon.

85. The rotary sprinkler of claim 84, wherein the portion of the flow shut off valve received inside the water supply tube has a plurality of stream straightening vanes located thereon.

86. The rotary sprinkler of claim 85, wherein the stream straightening vanes are circumferentially spaced apart relative to one another around the portion of the flow shut off valve received inside the water supply tube.

87. The rotary sprinkler of claim 84, wherein the drive provides oscillating, part circle rotation for the nozzle assembly.

88. An attachment for a rotary sprinkler having an outer sprinkler body closed by a cap at a top end of the sprinkler body, which comprises:

(a) a member that is configured to be releasably connected to a portion of the sprinkler, wherein the member is a collar that is sized to slip over the cap at the top end of the sprinkler body, and wherein the collar includes a plurality of resilient latching fingers for latching beneath the cap when the collar is received around the cap to hold the collar to the cap; and (b) an opening carried on the collar, the opening being sized to receive an upstanding post or stake provided in the ground such that the collar, and hence the rotary sprinkler to which the collar is connected, is supported by the post or stake.

89. The attachment of claim 88, in which the resilient latching fingers have upwardly extending portions for allowing the fingers to be deflected to release the fingers from their latching engagement beneath the cap when it is desired to remove the collar from the rotary sprinkler.

90. The attachment of claim 88, in which the collar includes tabs separate from the latching fingers that engage against a top side of the cap when the latching fingers engage beneath the cap.

91. The attachment of claim 88, in which the opening is a circular opening extending radially outwardly from one side of the collar.

* * * * *

UNITED STATES PATENT AND TRADEMARK OFFICE

CERTIFICATE OF CORRECTION

PATENT NO. : 6,945,471 B2
DATED : September 20, 2005
INVENTOR(S) : Jeff R. McKenzie et al.

It is certified that error appears in the above-identified patent and that said Letters Patent is hereby corrected as shown below:

Column 26,
Line 67, after "band" insert -- and --.

Column 29,
Lines 8 and 32, after "limit" insert -- stop --.
Line 38, change "spring" to -- sprinkler --.

Column 34,
Line 19, before "stream" insert -- the --.

Signed and Sealed this

Eighth Day of November, 2005

JON W. DUDAS
*Director of the United States Patent and Trademark Office*